US005438520A

United States Patent [19]

Satoh et al.

[11] Patent Number: 5,438,520

[45] Date of Patent: Aug. 1, 1995

[54] METHOD OF CREATING APPLIQUE DATA

[75] Inventors: Masaaki Satoh, Ohta; Akinori Kuroda, Ohmiya; Masashi Asai, Ichinomiya, all of Japan

[73] Assignees: Abushiki Kaisha Barudan, Ichinomiya; Ippon Denpa Co., Ltd., Tokyo, both of Japan

[21] Appl. No.: 221,926

[22] Filed: Apr. 1, 1994

[30] Foreign Application Priority Data

| | | | |
|---|---|---|---|
| Apr. 2, 1993 | [JP] | Japan | 5-100442 |
| Apr. 17, 1993 | [JP] | Japan | 5-113667 |
| Apr. 22, 1993 | [JP] | Japan | 5-120874 |
| Mar. 14, 1994 | [JP] | Japan | 6-070031 |

[51] Int. Cl.[6] ..... G05B 19/18

[52] U.S. Cl. ..... 364/470; 112/102.5; 112/475.19

[58] Field of Search ..... 364/470, 188–193; 112/102, 103, 454, 456, 457, 458, 121.12, 121.11, 453, 80.23, 445, 266.1, 262.3, 78, 79, 86, 78, 98

[56] References Cited

U.S. PATENT DOCUMENTS

| | | | |
|---|---|---|---|
| 4,825,784 | 5/1989 | Nomoto | 112/103 |
| 4,849,902 | 7/1989 | Yokoe et al. | 364/470 |
| 4,932,345 | 6/1990 | Takenoya et al. | 112/266.1 |
| 4,960,061 | 10/1990 | Tajima et al. | 112/103 |
| 5,005,500 | 4/1991 | Kato et al. | 112/121.12 |
| 5,311,439 | 5/1994 | Hayakawa et al. | 364/470 |
| 5,319,565 | 6/1994 | Hausammann et al. | 364/470 |
| 5,335,182 | 8/1994 | Asano | 364/470 |

*Primary Examiner*—James P. Trammell

*Attorney, Agent, or Firm*—Cushman, Darby & Cushman

[57] ABSTRACT

A method of creating data for an applique which has its lower and upper applique patches embroidered to lower and upper cloths, respectively, such that the lower cloth and applique patch and the upper cloth and applique patch can overlap and separate each other with a predetermined overlap margin. The applique data creating method includes the steps of: inputting synthetic contour data of the two applique patches when the lower and upper applique patches overlap each other with the predetermined overlap margin; inputting the individual overlap edge data of the lower and upper applique patches; creating the individual contour data of the lower and upper applique patches from the synthetic contour data and the individual overlap edge data; and creating the individual embroidering data of the lower and upper applique patches on the basis of the individual contour data of the lower and upper applique patches.

14 Claims, 17 Drawing Sheets

(a)

METHOD OF CREATING APPLIQUE DATA

BACKGROUND OF THE INVENTION

1. Field of the Invention

The present invention relates to a method of creating various data for cutting an applique patch, positioning it on a cloth to be worked, coarsely basting it, and embroidering it with satin stitches.

2. Description of Related Art

In a uniform coat 50 of front open type, as shown in FIGS. 27 and 28, a lower front body 51 and an upper front body 52 are overlapped and separated with a constant overlap margin. When an applique bearing a team name is to be embroidered to those front bodies 51 and 52, it may be cut at the overlap portion between the lower and upper front bodies 51 and 52. In this case, there are used applique patches 53 and 54 which are formed to provide a continuous synthetic contour with that constant overlap margin when the lower and upper front bodies 51 and 52 are overlapped.

The two applique patches 53 and 54 shown in FIGS. 27 and 28 constitute a series of letters (or synthetic contour) of "Angels" when they are overlapped. The lower applique patch 53 terminates at the righthand position of the letter "g" to provide an overlap margin 55 at its terminal edge, and the upper applique patch 54 terminates at the lefthand position of the letter "g" to provide an overlap margin 56 at its terminal edge. The lower applique patch 53 and the upper applique patch 54 are arranged on the lower front body 51 and the upper front body 52, respectively, and are embroidered with satin stitches 57 by an automatic control type embroidering machine.

In the conventional art, the various data for cutting the applique patches 53 and 54, positioning them on the front bodies 51 and 52, coarsely basting them and embroidering them with the satin stitches are separately created, as follows, so that especially the contour data have to be inputted many times with serious troubles.

(1) Creation of Data for Lower Applique Patch 53

<1> A pattern drawn with the contour of the upper applique patch is adhered to a digitizer, and its essential points are picked up by a pointing device so that its data are inputted. From these contour data, there are created, by a cutting data creating system, cutting data for causing a cutting machine to cut the applique patch.

<2> Then, the contour data of the lower applique patch are inputted. From these contour data, there are created, by an embroidering data creating system, positioning temporary stitch data for causing an embroidering machine to stitch the cloth temporarily.

<3> Then, the contour data of the lower applique patch are inputted, and inner circumference data and outer circumference data along the contour data are inputted and created. From these contour data and inner circumference data, there are created, by an embroidering data creating system, basting stitch data for causing the embroidering machine to stitch the applique patch coarsely.

<4> From the inner circumference data and outer circumference data, there are created, by the embroidering data creating system, satin stitch data for causing the embroidering machine to form the satin stitches 57.

(2) Creation of Data for Upper Applique Patch 54

For the upper applique patch 54, like the lower applique patch 53, the cutting data, the positioning temporary stitch data, the basting stitch data and the satin stitch data are created in the procedure of the aforementioned steps <1><2><3><4>.

SUMMARY OF THE INVENTION

An object of the present invention is to solve the above-specified problems and to create the several data of lower and upper applique patches efficiently by a single step of inputting synthetic contour data and overlap edge data in an applique in which the two applique patches are overlapped with a constant overlap margin to provide a continuous, synthetic contour.

According to an aspect of the present invention, there is provided a method of creating data for an applique which has its lower and upper applique patches embroidered to lower and upper cloths, respectively, such that the lower cloth and applique patch, and the upper cloth and applique patch, can overlap and separate each other with a predetermined overlap margin. The present invention comprises a synthetic contour data inputting step of inputting synthetic contour data of the two applique patches when the lower and upper applique patches overlap each other with the predetermined overlap margin; an overlap edge data inputting step of inputting individual overlap edge data of the lower and upper applique patches; a contour data creating step of creating the individual contour data of the lower and upper applique patches from the synthetic contour data and the individual overlap edge data; and an embroidering data creating step of creating individual embroidering data of the lower and upper applique patches on the basis of the individual contour data of the lower and upper applique patches.

The applique data creating method may further comprises a cutting data creating step of creating individual cutting data of the lower and upper applique patches on the basis of the individual contour data of the lower and upper applique patches, which are created at the contour data creating step.

In the applique data creating method, the individual embroidering data of the lower and upper applique patches, which are created at the embroidering data creating step, may include: temporary stitch data for positioning the lower and upper applique patches individually for forming the positioning temporary stitches of the lower and upper applique patches, respectively, in the lower and upper cloths; basting stitch data for temporarily stitching the lower and upper applique patches coarsely to the lower and upper cloths, respectively; and satin stitch data for satin-stitching the lower and upper applique patches, respectively, to the lower and upper cloths.

In the applique data creating method, the embroidering data creating step may include a sub-step of: creating temporary stitch data for positioning the lower and upper applique patches, respectively, from the individual contour data of the lower and upper applique patches, which are created at the contour data creating step; and setting the starting point of the positioning temporary stitch data to the intersection points between the positioning temporary stitch data and the overlap edge data of the lower and upper applique patches, which are inputted at the overlap edge data inputting step.

In the applique data creating method, the embroidering data creating step may include a sub-step of: creating inner circumference data along the inner circumference of the individual contour data of the lower and upper applique patches, which are created at the contour data creating step; and creating individual basting stitch data of the lower and upper applique patches from the individual contour data and the individual inner circumference data.

In the applique data creating method, the embroidering data creating step may include a sub-step of: creating inner circumference data and outer circumference data respectively along the inner and outer circumferences of the individual contour data of the lower and upper applique patches, which are created at the contour data creating step; and creating individual satin stitch data of the lower and upper applique patches from the inner circumference data and the outer circumference data.

In the applique data creating method, the embroidering data creating step may include a sub-step of creating thread interchanging data in the satin stitch data of the upper applique patch, which are created in the same step, for interchanging the satin stitch thread for stitching the overlap edge of the upper applique patch and the satin stitch thread for stitching the remainder of the upper applique patch.

In the applique data creating method, the embroidering data creating step may decide a creating side automatically and may include a sub-step of: extending search lines in one direction from arbitrary points of the individual contour data of the lower and upper applique patches, which are created at the contour data creating step, to other portions of the contour data; determining the number of intersection points between the search lines and other portions of the individual contour data; and creating the inner circumference data and the outer circumference data correctly at the inner circumference side and the outer circumference side with respect to the individual contour data on the basis of the extending direction of the search lines, the advancing direction of the individual contour data at the arbitrary points, and the number of the intersection points.

In the applique data creating method, in case the contour data of the lower and upper applique patches have two-curve intersecting portions, the embroidering data creating step may include a sub-step of: setting a phantom line joining the intersection points of the inner circumference data and the intersection points of the outer circumference data in the two-curve intersecting portions as the boundary of the two-curve portions of the satin stitch data for satin-stitching the two curves; and changing the seam direction of the two-curve portions of the satin stitch data so gradually as to become the more parallel to the boundary as the closer to the boundary.

In the applique data creating method, in case the edge portion of the upper applique patch is arranged to be substantially registered with the edge portion of the upper cloth, the embroidering data creating step may include a sub-step of creating satin stitch data of the upper applique patch, so that the satin stitch data of the upper applique patch may contain data of a forward stitch portion formed from the non-edge portion to the edge portion of the upper cloth and data of a backward stitch portion which is so terminated by at least four stitches as to be returned from the starting end of the forward stitch portion to the non-edge portion of the cloth. It is preferable to make at least six stitches in the backward stitch portion, and more preferably at least ten stitches.

In the applique data creating method, the embroidering step may include a sub-step of creating data of the forward stitch portion at a substantially constant pitch from the non-edge portion to the edge portion of the upper cloth.

In the applique data creating method, the embroidering data creating step may include a sub-step of creating data of the forward stitch portion at a substantially constant pitch in the non-edge portion of the upper cloth and with jumping stitch data from this side of the edge portion of the upper cloth and to the edge portion.

In the applique data creating method, the embroidering data creating step may include a sub-step of creating the data of the forward stitch portion at a substantially constant pitch in the non-edge portion of the upper cloth and at a coarser pitch from this side of the edge portion of the upper cloth to the edge portion.

In the applique data creating method, the embroidering data creating step may include a sub-step of creating basting stitch data having such a small stitch length as is doubled on the final stitch of the backward stitch portion from the starting end of the final stitch and is terminated midway of the final stitch.

The material to be used for the cloth to be worked or the applique patches in the present invention includes not only woven fabric but also leather, a resin sheet and a composite sheet.

The means for inputting contour data in the present invention can be exemplified by a digitizer (including a tablet indicating a small-sized digitizer), an image scanner, a touch panel, a write pen, a mouse and a track ball. Moreover, the means for creating inner circumference data, outer circumference data and stain stitch data can be exemplified by a microcomputer.

According to the applique data creating method of the present invention, several data for the lower and upper applique patches of an applique, in which the two applique patches are overlapped with a constant overlap margin to provide a continuous, synthetic contour, can be efficiently created by a single step of inputting synthetic contour data and overlap edge data.

Further objects of this invention will become evident upon an understanding of the illustrative embodiments described below. Various advantages not referred to herein but within the scope of the instant invention will occur to one skilled in the art upon practice of the instantly disclosed invention. The following examples and embodiments are illustrative and not seen to limit the scope of the invention.

DETAILED DESCRIPTION OF THE PREFERRED EMBODIMENTS

Figure 1:
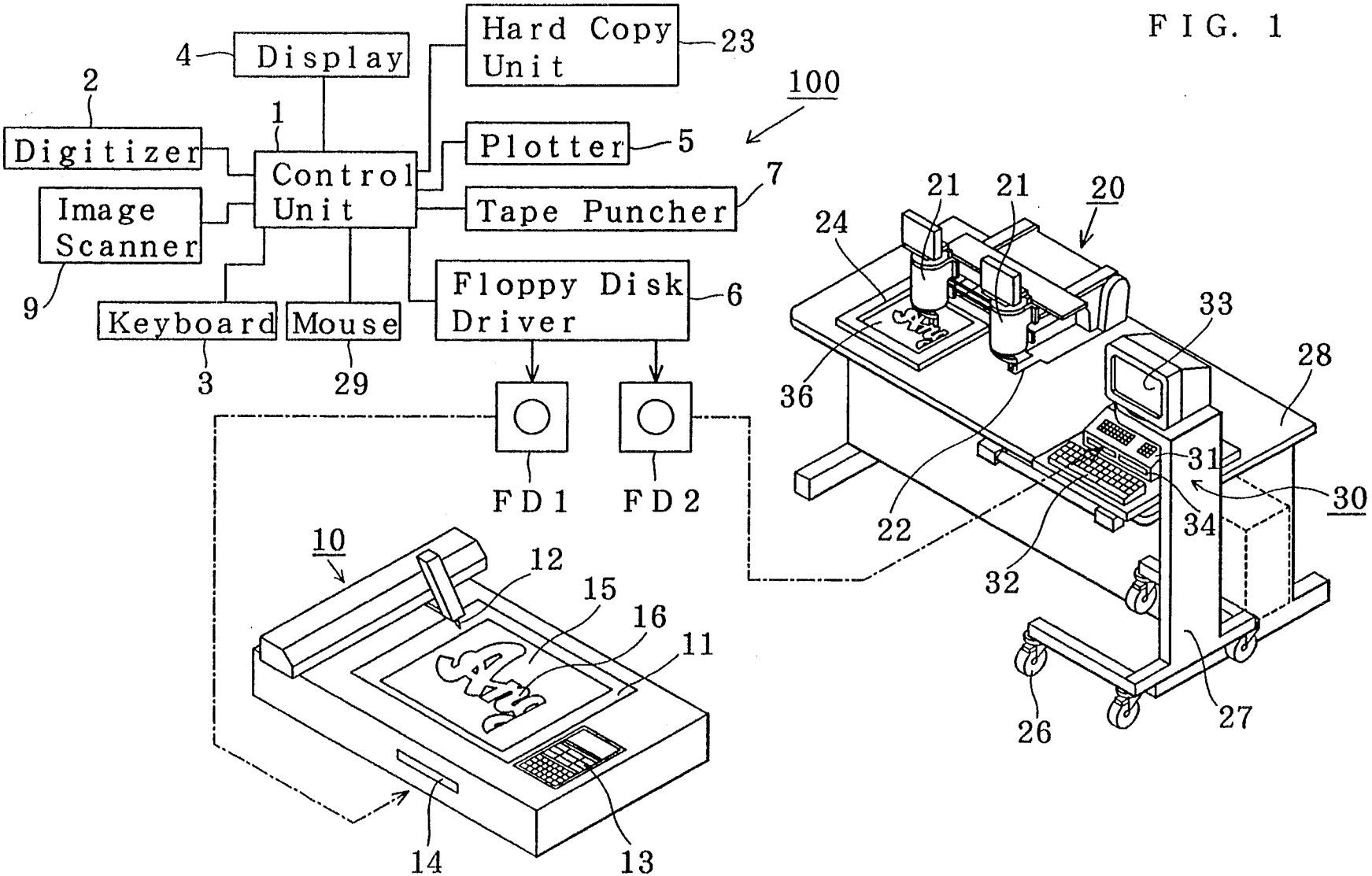
FIG. 1 is a diagram showing the entire construction of a system to be used in an embodiment of the present invention.
Figure 2:
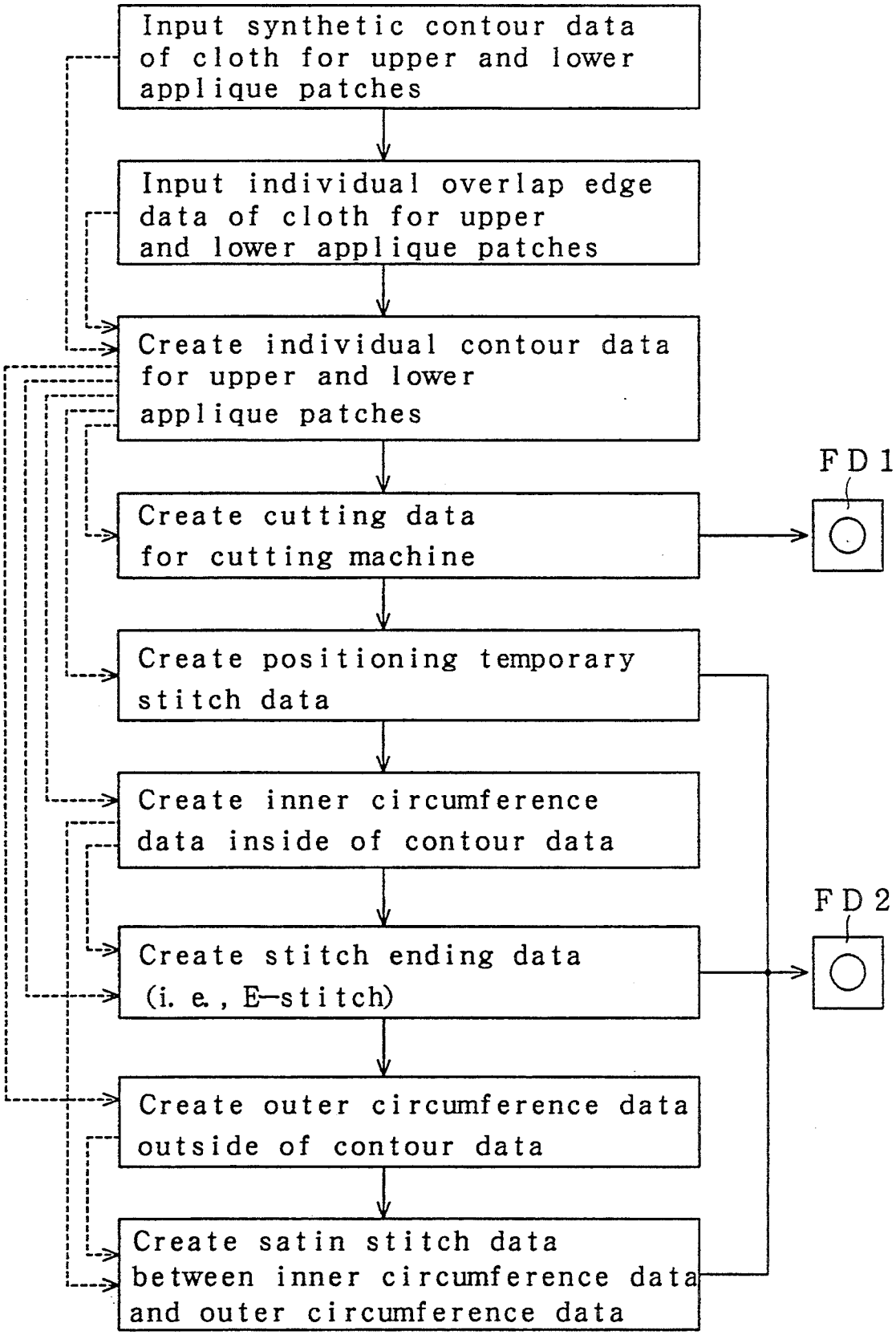
FIG. 2 is a flow chart showing a method of creating cutting data and embroidering data of the present embodiment.

Here will be described the present invention in connection with its embodiment with reference to FIGS. 1 to 26. FIG. 1 shows a system to be used in this embodiment. A data creating system 100 includes a control unit 1, for which is used a microcomputer composed of a CPU, a ROM, a RAM, connecting buses and input/output interfaces. With this control unit 1, there are connected input devices including a keyboard 3, a mouse 29, a digitizer 2 and an image scanner 9. Of these, the digitizer 2 and the image scanner 9 are selectively used by switching the input mode of the control unit 1 through the keyboard 3. With the control unit 1, there are further connected a display 4 as a display unit, an X-Y plotter 5 and a hard copy unit 23 as printers, and a floppy disk driver 6 and a tape puncher 7 as external memory units.

The aforementioned construction of the data creating system 100 presents only one example but can be modified to use a hard disk driver (including a removable type), a magnetic tape driver, a magnetic card driver, a magneto-optic disk driver, an optical disk driver or an IC card driver as the external memory unit.

Reference numeral 10 designates a cutting machine for cutting an applique patch. This cutting machine 10 is constructed to include: a machine face 11 to be set with cloth; a heat cutter 12 adapted to be driven in X-Y directions and to be reciprocated, if necessary, in a Z-axis direction; a control keyboard 13; and a floppy disk driver 14 acting as an input device. Into this floppy disk driver 14, there is inserted a floppy disk FD1 which has been recorded with cutting data by the floppy disk driver 6.

The heat cutter can be replaced by a cutting blade, a laser cutting unit, a liquid Jet cutter or the like. In case any of the aforementioned external memory units other than the floppy disk driver is used in the data creating system 100, a corresponding one of the external memory units need using in the cutting machine. Moreover, the data creating system 100 and the cutting machine 10 can be connected through a transmission cable or a radio transmission device so that the cutting data created by the data creating system 100 can also be directly transmitted to the cutting machine 10.

Numeral 20 designates an embroidering machine for embroidering the applique patch to the cloth. This embroidering machine 20 is constructed to include: a plurality of embroidering heads 21 for vertically driving needles carrying threads; a bed 22 having a shuttle race and a bobbin mounted therein; an embroidery frame 24 for extending a lower front body 36 or an upper front body 37 of a coat; and a driver (not-shown) for the embroidery frame 24. On a truck 27 made movable by casters 26, there is supported a machine control unit 30 which can be arranged on a table 28. This machine control unit 30 is constructed to include: a control panel 31; a keyboard 32; a display 33; and a floppy disk driver 34 mounted in the control panel 31 and acting as an input device. Into the floppy disc driver 34, there is inserted a floppy disk FD2 which is recorded with embroidering data by the floppy disc driver 6.

In case any of the aforementioned external memory devices other than the floppy disc driver is used in the data creating system 100, a corresponding one of the external memory devices need using in the machine control unit 30. Moreover, the data creating system 100 and the machine control unit 30 can be connected through a transmission cable or a radio transmission device so that the embroidering data created by the data creating system 100 can also be directly transmitted to the machine control unit 30.

Figure 20:
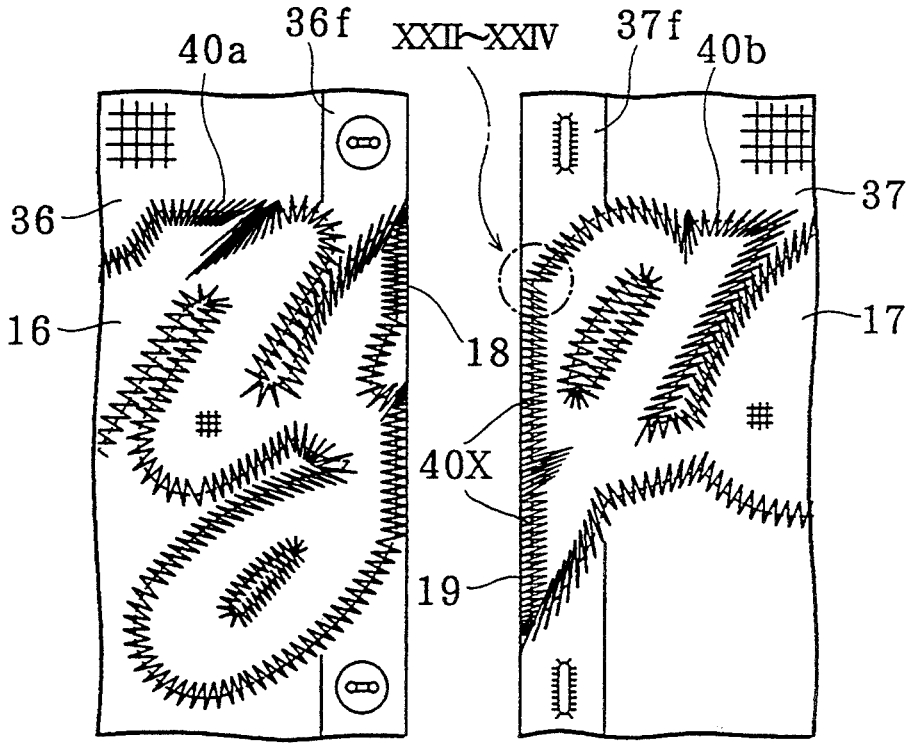
FIG. 20 is a front elevation showing portions of the lower front body and the upper front body of the coat, to which is satin-stitched the applique patches.
Figure 21:
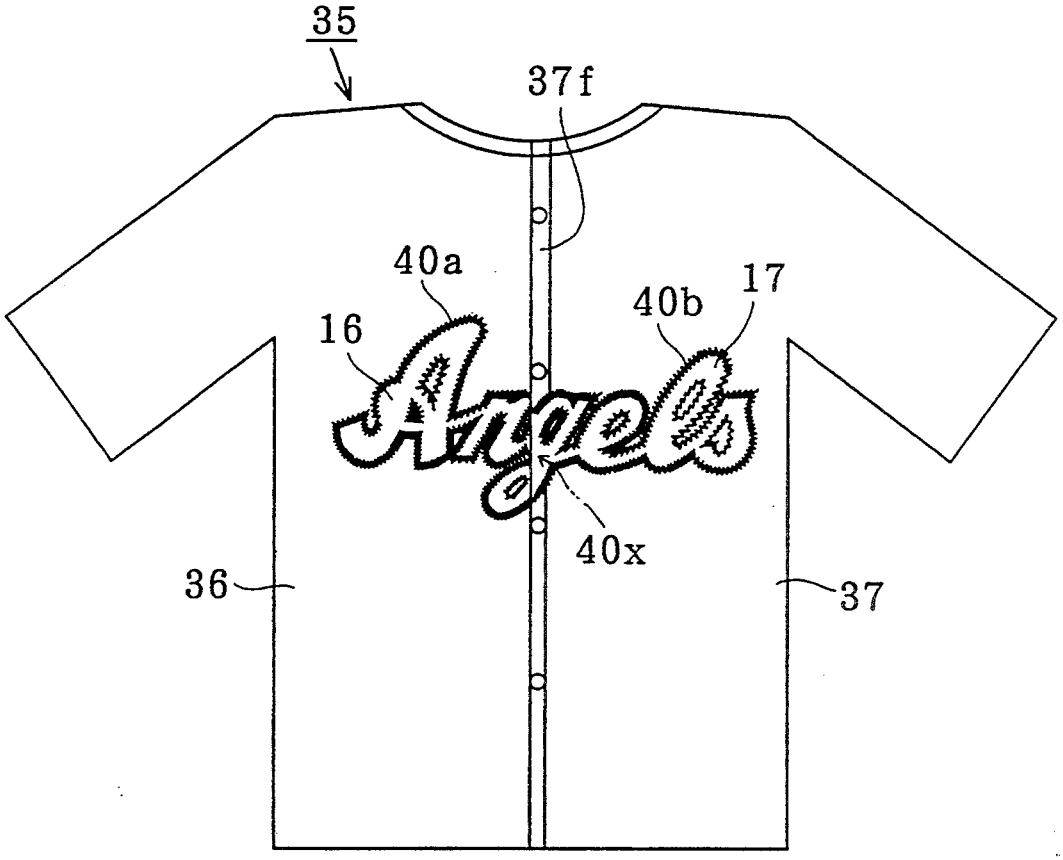
FIG. 21 is a front elevation showing a uniform coat which has the same applique patches stitched thereto.

In this embodiment, as shown in FIG. 21, there are created: the cutting data for cutting, from the cloth, lower and upper applique patches 16 and 17 which constitute a series of letters (i.e., a synthetic contour) of "Angels", when overlapped; and the embroidering data for embroidering the applique patches 16 and 17 respectively to the lower front body 36 and the upper front body 37 of a uniform coat 35. As in the aforementioned example of the conventional art, the lower front body 36 and the upper front body 37 are overlapped and separated with a predetermined overlap margin so that the two applique patches 16 and 17 are also overlapped with the predetermined overlap margin when the two front bodies 36 and 37 are overlapped. As shown in FIG. 20, moreover, the lower applique patch 16 terminates at the righthand position in the letter "g" to leave an overlap edge 18 at its terminal edge, and the upper applique patch 17 terminates at the lefthand position in the letter "g" to leave an overlap edge 19 at its terminal edge. The method of creating those cutting data and embroidering data is proceeded by the procedure shown in FIG. 2. Arrowed broken lines appearing in FIG. 2 designate the flows of data. This procedure will be described in detail in the following.

(1) Input Synthetic Contour Data of Applique Patches

Figure 3:
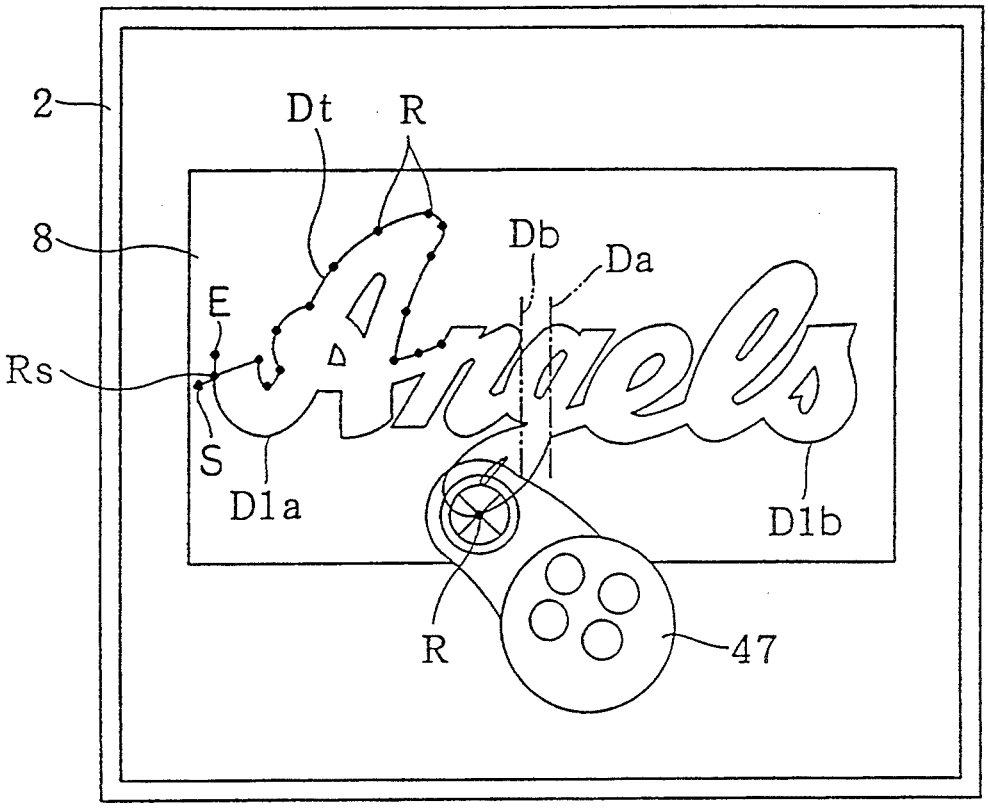
FIG. 3(*a*) is an explanatory view showing a step of inputting synthetic contour data and overlap edge data, and FIG. 3(*b*) is a front elevation showing the picture of a display at the inputting step.
Figure 3:
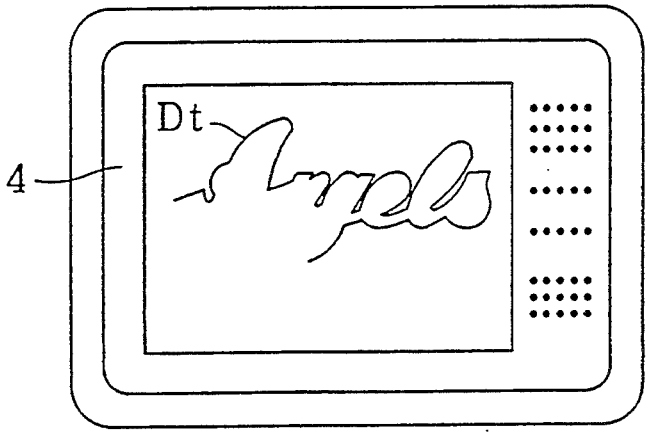

As shown in FIG. 3(*a*), a pattern 8 drawn with the synthetic contour of "Angels" is adhered to the board face of the digitizer 2. Synthetic contour data Dt are inputted by picking up a plurality of essential points R (although partially shown) of the synthetic contour with a pointing device 47 such as a button cursor or a stylus pen. On the display 4, as shown in FIG. 3(*b*), there are displayed the synthetic contour data Dt which are made by joining the picked-up points sequentially with lines. The synthetic contour data Dt thus displayed on the display 4 can be corrected by the mouse 29 or indicate the starting point of the later-described cutting data or embroidering data.

Essential point Rs to be picked up at first may be anywhere (although located at the lefthand side of the drawing). If, moreover, a point somewhat ahead of the essential point Rs is picked up as a starting point S, if the essential points R are sequentially picked up and if a point slightly passing the essential point Rs is picked up as an ending point E, the later-described initial cutting portion and terminal cutting portion in the cutting data never fail to cross so that no portion is preferably left uncut.

In case, the image scanner 9 is used in place of the digitizer 2, the contour of the pattern 8 is directly read by the image scanner 9, and the read contour is displayed on the display 4 so that it may be corrected or indicated by the mouse 29, as described above.

(2) Input of Overlap Edge Data of Applique Patches

Subsequently, overlap edge data Da (i.e., the righthand position in the letter "g") indicating the overlap edge of the lower applique patch 16 and overlap edge data Db (i.e., the lefthand position in the letter "g") indicating the overlap edge of the upper applique patch 17 are inputted by picking up them by the pointing device 47.

(3) Create Contour Data of Applique Patches

The control unit 1 creates contour data D1a of the lower applique patch 16 automatically by cutting out the synthetic contour data Dt at the overlap edge data Da, and contour data D1b of the upper applique patch 17 by cutting out the synthetic contour data Dt at the overlap edge data Db.

(4) Create Cutting Data of Applique Patches

Figure 4:
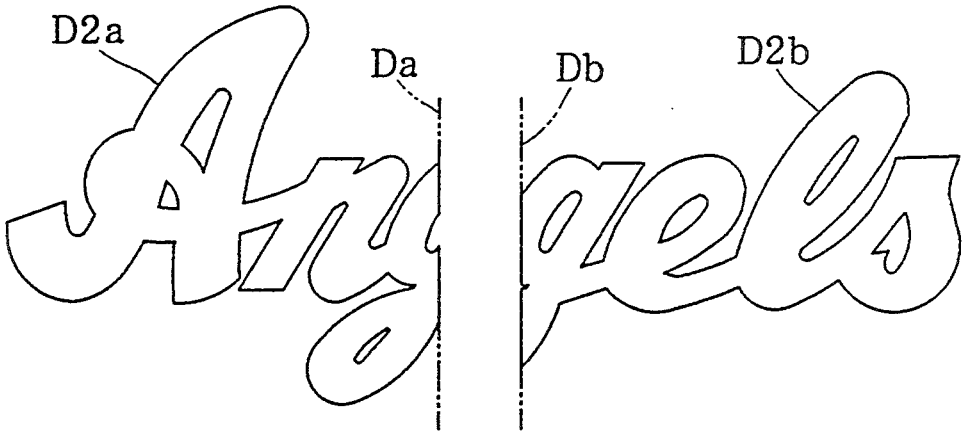
FIG. 4 is an explanatory view showing the cutting data created.

The control unit 1 creates individual cutting data D2a and D2b of the lower and upper applique patches 16 and 17, as shown in FIG. 4, automatically from the individual contour data D1a and D1b. These individual cutting data D2a and D2b are recorded in the floppy disk FD1 by the floppy disk driver 6.

(5) Create Embroidering Data of Applique Patches

Figure 5:
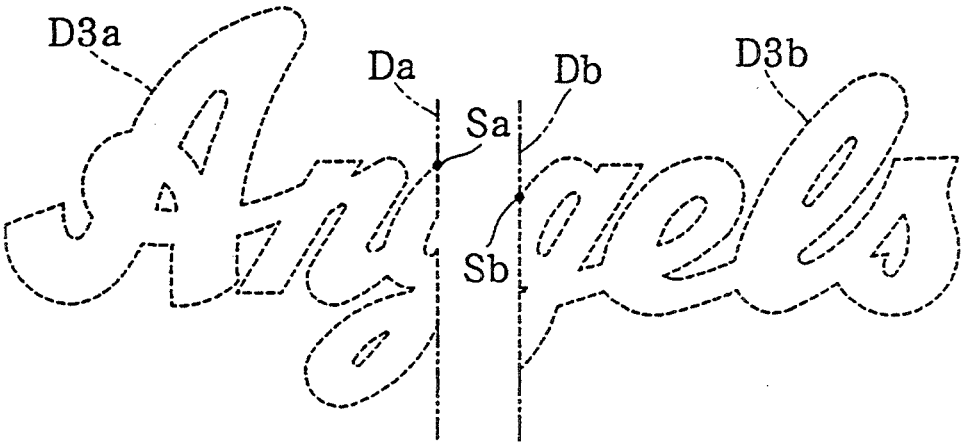
FIG. 5 is an explanatory view showing positioning temporary stitch data created.

<1) The control unit 1 automatically creates positioning temporary stitch data D3a and D3b, as shown in FIG. 5, from the individual contour data D1a and D1b necessary for positioning the applique patches 16 and 17, respectively, in the front bodies 36 and 37. The control unit 1 further automatically sets starting points Sa and Sb of the individual positioning temporary stitch data D3a and D3b in the intersection points (which may be at either lower or upper ones) with the individual overlap edge data Da and Db. The individual positioning temporary stitch data D3a and D3b (including the data of the starting points Sa and Sb, as in the following) are recorded in the floppy disk FD2 by the floppy disk driver 6.

Figure 6:
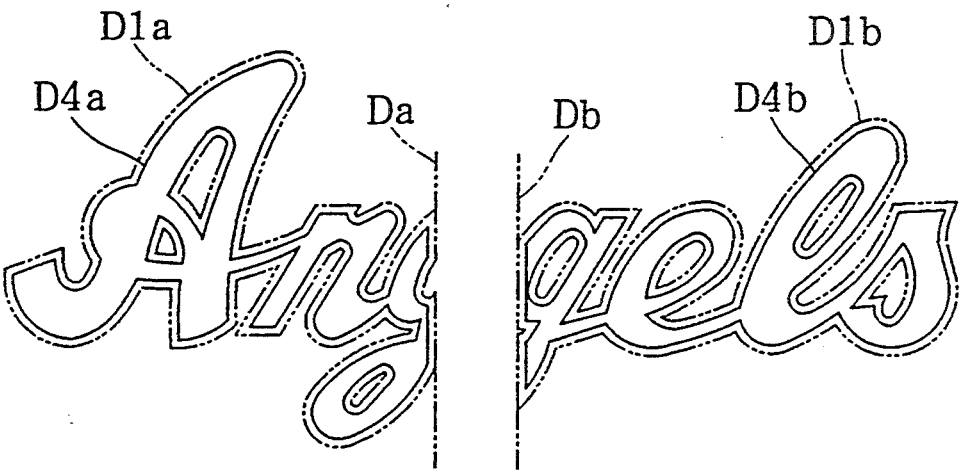
FIG. 6 is an explanatory view showing inner circumference data created.

<2> Next, the control unit 1 automatically creates inner circumference data D4a and D4b along the inner circumferences of the individual contour data D1a and D1b, as shown in FIG. 6, from the individual contour data D1a and D1b.

Figure 7:
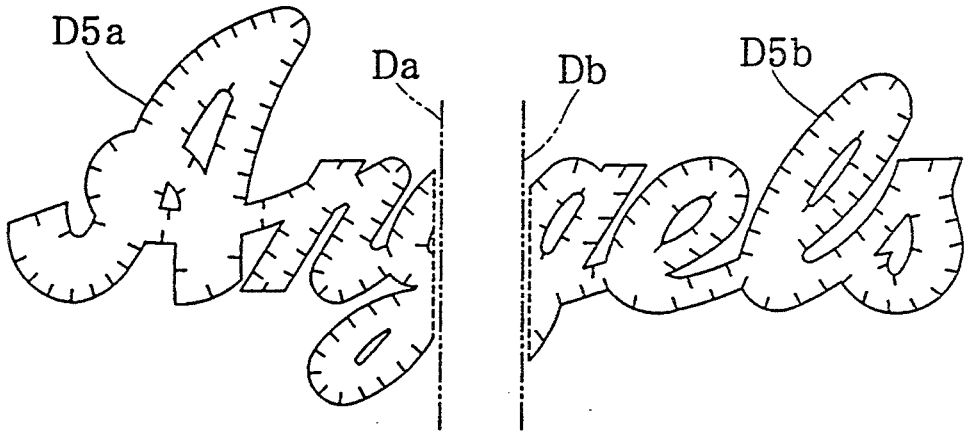
FIG. 7 is an explanatory view showing basting stitch data created.
Figure 8:
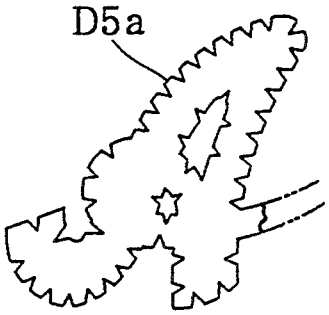
FIG. 8 is an explanatory view showing another example of the basting stitch data.

<3> Then, the control unit 1 automatically creates basting stitch data D5a and D5b, as shown in FIG. 7, from the individual contour data D1a and D1b and inner circumference data D4a and D4b necessary for basting the individual applique patches 16 and 17. E-stitch data as the basting stitch data D5a and D5b excepting the edge portions, in this embodiment, and running stitch data as that of the edge portions are created on the basis of both the stitching direction of the E-stitches inputted in advance from the keyboard 3 to the control unit 1 and the stitch number from one stitch to a next stitch. The basting stitch data should not be limited to the E-stitches or running stitches but can be exemplified by the basting stitch data D5a of another kind, as shown in FIG. 8. These basting stitch data D5a and D5b are recorded in the floppy disk FD2 by the floppy disk driver 6.

Figure 9:
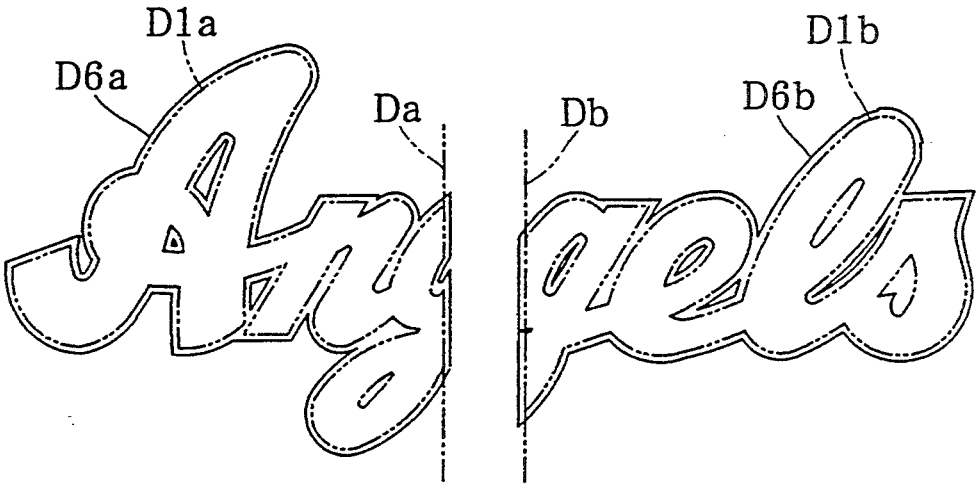
FIG. 9 is an explanatory view showing outer circumference data created.

<4> Then, the control unit 1 automatically creates outer circumference data D6a and D6b, as shown in FIG. 9, along the outer circumferences of the individual contour data D1a and D1b from the individual contour data D1a and D1b.

In case the individual contour data D1a and D1b have such complicated shapes as in the present embodiment, there arise fears that the individual inner circumference data D4a and D4b may be erroneously created at the outer circumferences of the individual contour data D1a and D1b and that the individual outer circumference data D6a and D6b may be erroneously created at the inner circumferences of the individual contour data D1a and D1b.

Figure 10:
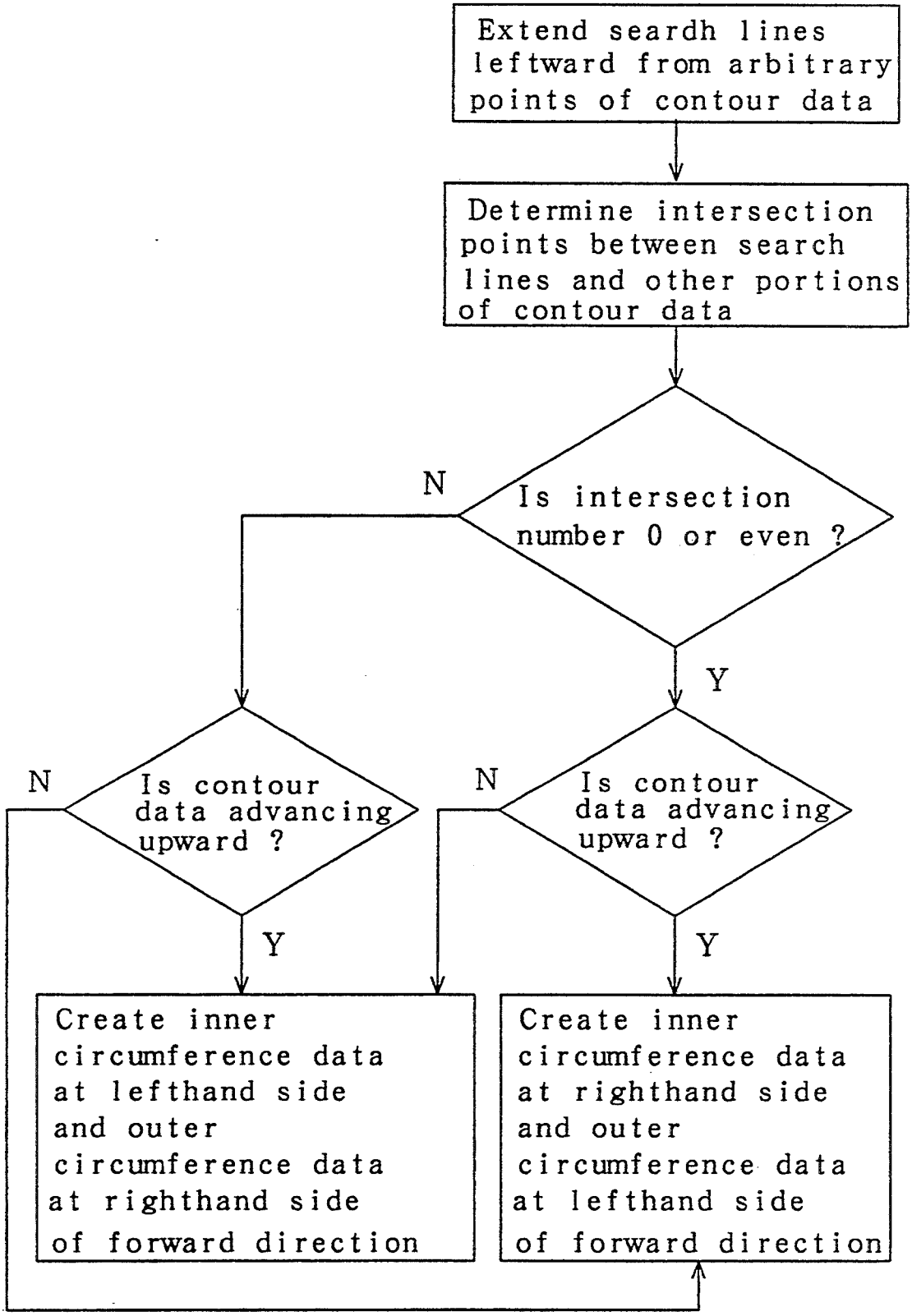
FIG. 10 is a flow chart showing a method of automatically deciding the creating sides of the inner circumference data and the outer circumference data with respect to the contour data.

In the present embodiment, therefore, the sides, at which the individual inner circumference data D4a and D4b and outer circumference data D6a and D6b are created, are so automatically decided by the procedure shown in FIG. 10 that the individual inner circumference data D4a and D4b and outer circumference data D6a and D6b may be correctly created at the inner and outer circumferences, respectively, with respect to the individual contour data D1a and D1b, as will be described in detail in the following.

Figure 11:
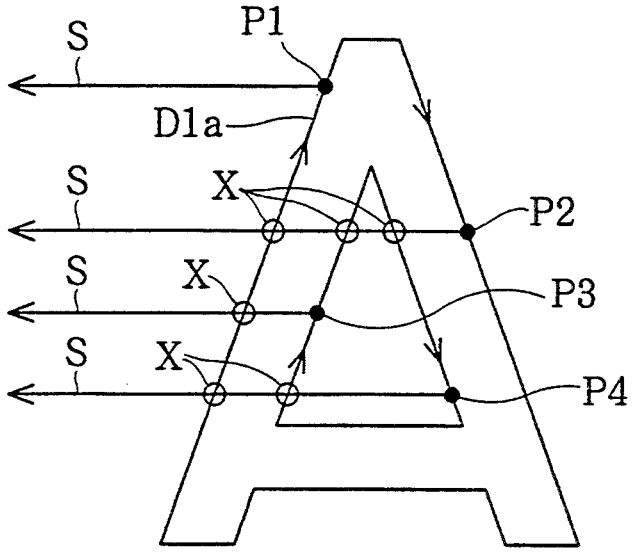
FIG. 11 is an explanatory view showing the same automatic deciding method.
Figure 12:
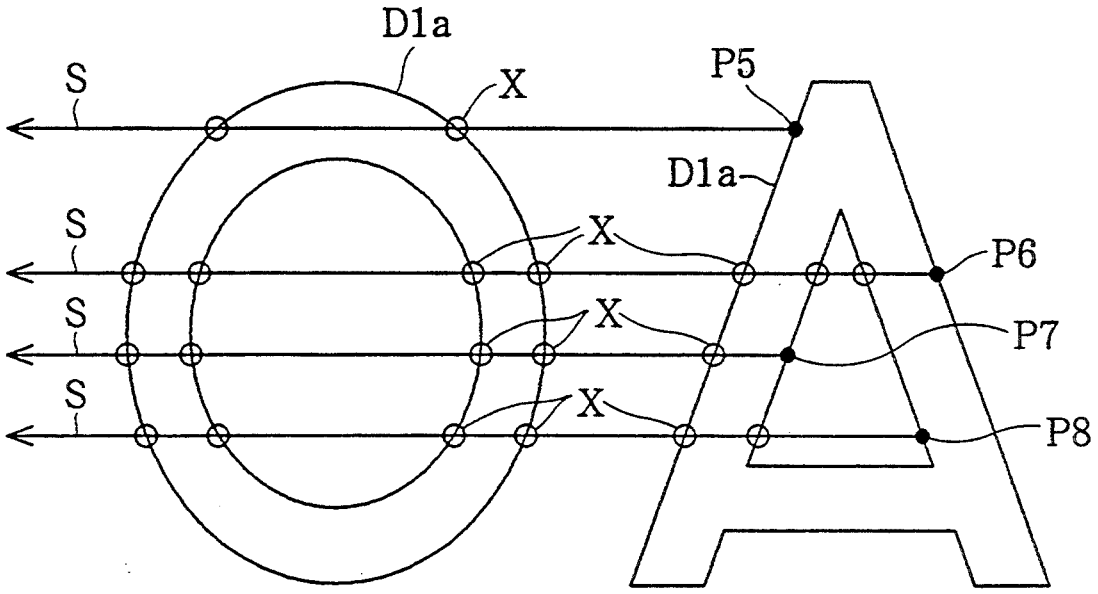
FIG. 12 is an explanatory view showing another example of the same automatic deciding method.
Figure 13:
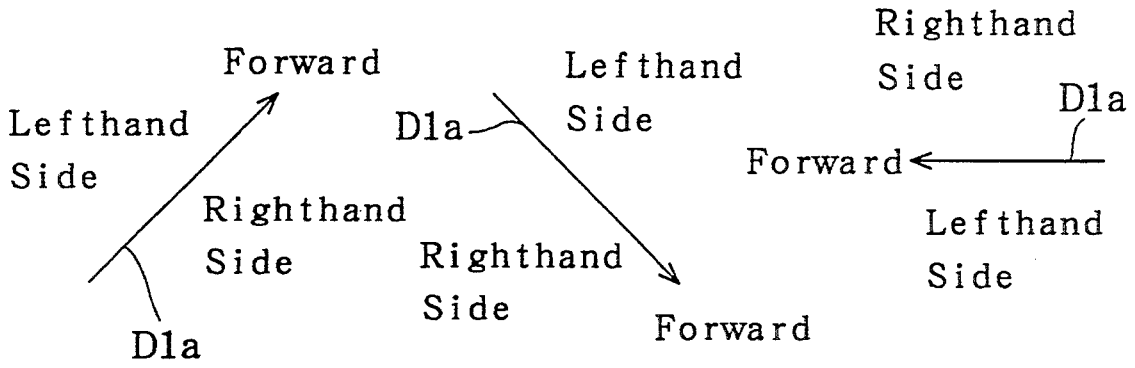
FIG. 13 is an explanatory view showing the definition of the creating sides of the inner circumference data and the output circumference data in the same automatic deciding method.

(a) Since the individual contour data D1a and D1b of the present embodiment have the rather complicated shapes, they will be described in the following in case the portion of letter "A" of the contour data D1a is replaced by a simplified shape of letter "A", as shown in FIG. 11. Another example will be described together in case the portion of letter "O" of the contour data D1a is added to the letter "A" portion, as shown in FIG. 12. As shown in FIGS. 11 and 12, search lines S are extended in one direction (e.g., leftward of FIGS. 10 to 12) from arbitrary points P1, P2, P3, P4, P5, P6, P7 and P8 (of which the points P3, P4, P7 and P8 are arbitrary points in the blank portion) of the contour data D1a.

(b) The number of intersection points X of those search lines S and the remaining portions of the contour data D1a is determined and then decided whether it is 0, even or odd. The side, at which the inner circumference data D4a and the outer circumference data D6a are created, is automatically decided with respect to the contour data D1a on the basis of the extending direction of the search lines S, the advancing direction of the contour data D1a at the arbitrary points P1 to P8 and the number of the intersection points X in accordance with the following Table 1 and FIG. 10. Table 1 enumerates the cases in which the extending directions of the search lines S are leftward and rightward, but FIG. 10 shows only the deciding procedure in case the extending direction of the search lines S is leftward.

TABLE 1

| Direction of S-Line* | Direction of C-Data* | No. of Inter.* | Side of IC-Data* | Side of OC-Data* |
|---|---|---|---|---|
| Leftward | Upward | 0, Even | Right | Left |
| Leftward | Upward | Odd | Left | Right |
| Leftward | Downward | 0, Even | Left | Right |
| Leftward | Downward | Odd | Right | Left |
| Rightward | Upward | 0, Even | Left | Right |
| Rightward | Upward | Odd | Right | Left |
| Rightward | Downward | 0, Even | Right | Left |
| Rightward | Downward | Odd | Left | Right |

In Table 1:
Direction of S-Line*: Extending Direction of Search Lines
Direction of C-Data*: Advancing Direction of Contour Data
No. of Inter.*: Number of Intersection Points
Side of IC-Data*: Creating Side of Inner Circumference Data
Side of OC-Data*: Creating Side of Outer Circumference Data
Right*: Righthand Side of Advancing Direction
Left*: Lefthand Side of Advancing Direction In Table 1, the "righthand or lefthand side of the advancing direction" means the righthand or lefthand side, as taken in the advancing direction of the contour data D1a. By this decision procedure, the automatic decisions are made, as in the following Table 2, at the arbitrary points P1 to P8 of FIGS. 11 or 12. As in Table 2, the decisions at the arbitrary points P1 to P4 in FIG. 11 and the decisions at the arbitrary points P5 to P8 in FIG. 12 are coincident. Moreover, correct decisions are also achieved at the arbitrary points P3, P4, P7 and P8 in the blank portion.

TABLE 2

| Arbitrary Points | Direction of C-Data* | No. of Inter.* | Side of IC-Data* | Side of OC-Data* |
|---|---|---|---|---|
| P1 | Upward | 0 | Right | Left |
| P2 | Downward | 3 | Right | Left |
| P3 | Upward | 1 | Left | Right |
| P4 | Downward | 2 | Left | Right |
| P5 | Upward | 2 | Right | Left |
| P6 | Downward | 7 | Right | Left |
| P7 | Upward | 5 | Left | Right |
| P8 | Downward | 6 | Left | Right |

Figure 14:
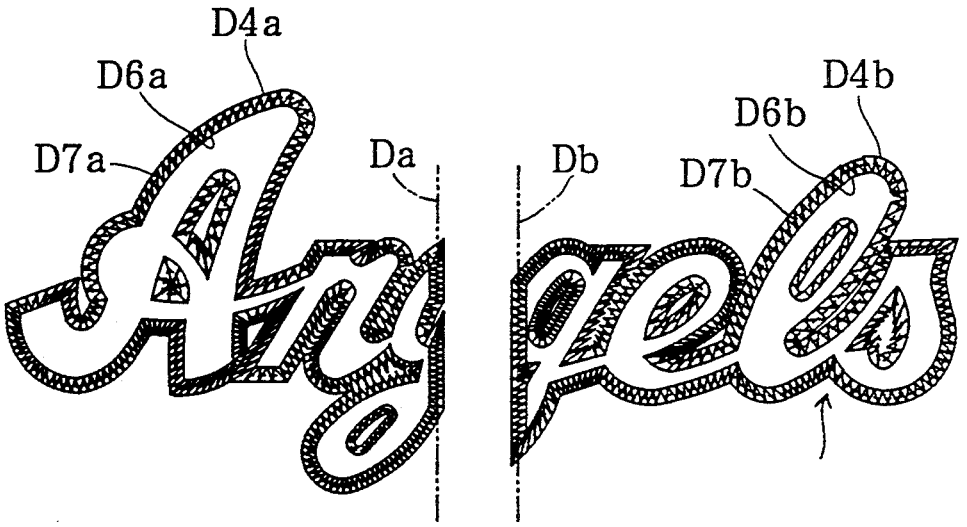
FIG. 14 is an explanatory view showing satin stitch data created.

In Table 2:
Direction of C-Data*: Advancing Direction of Contour Data
No. of Inter.*: Number of Intersection Points
Side of IC-Data*: Creating Side of Inner Circumference Data
Side of OC-Data*: Creating Side of Outer Circumference Data
Right*: Righthand Side of Advancing Direction
Left*: Lefthand Side of Advancing Direction <5> Then, the control unit 1 creates satin stitch data D7a and D7b necessary for embroidering the individual applique patches 16 and 17, as shown in FIG. 14, by jointing the inner circumference data D4a and D4b and outer circumference data D6a and D6b.

Figure 15A:
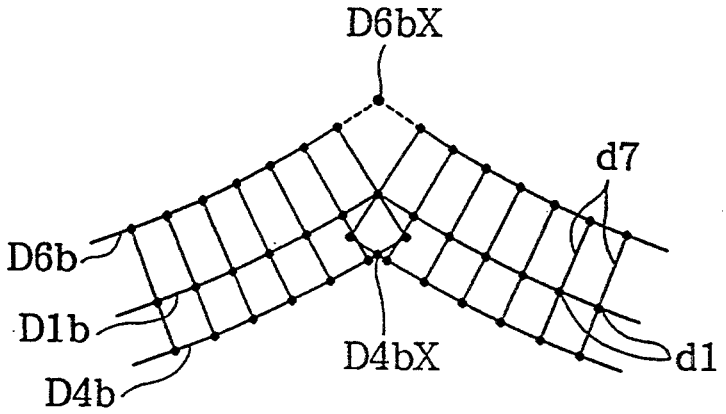
FIG. 15 is an explanatory view showing two-curve portions of the satin stitch data in the order (a), (b) and (c) of creation.
Figure 15B:
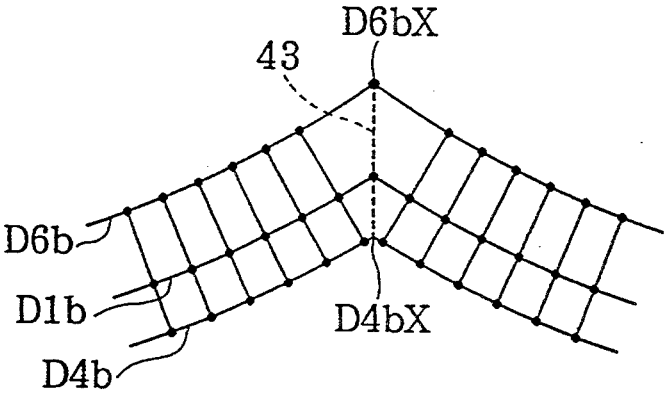
Figure 15C:
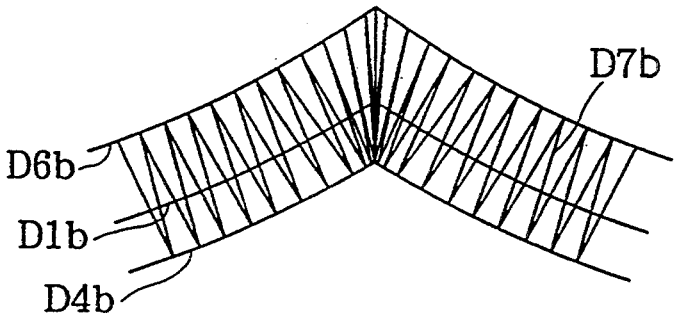
Figure 16:
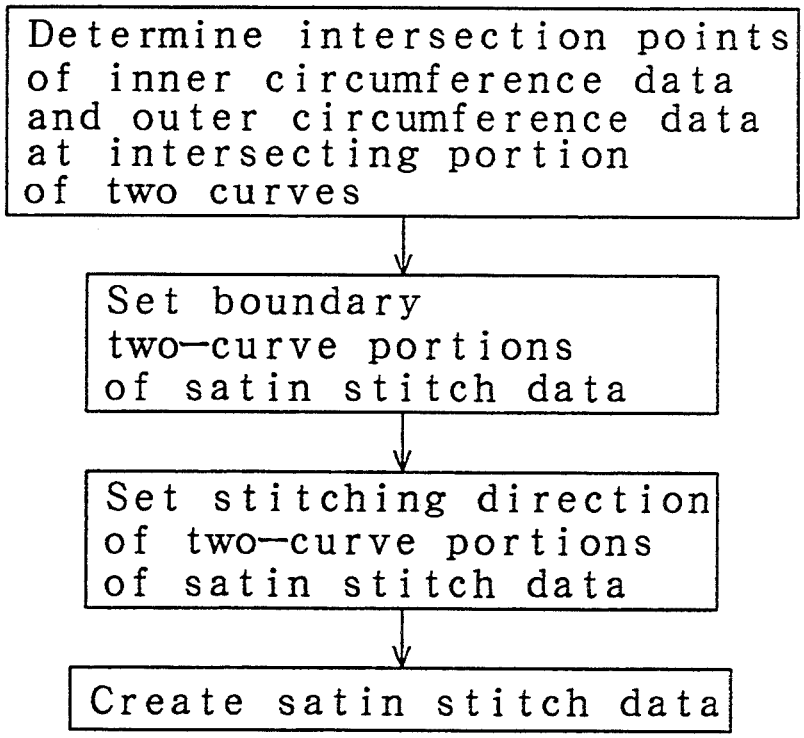
FIG. 16 is a flow chart showing the procedure of creating the two-curve portions of the satin stitch data.

Here, the control unit 1 creates the two-curve portions of the satin stitch data D7b for stitching the intersecting portions of the two curves, as located in the lefthand lower portion of the letter "s" of the upper applique patch 17, for example, by the procedure as shown in FIGS. 15 and 16. Specifically:

(a) As shown in FIG. 15(*a*), there are determined an intersection point D4bx of the inner circumference data D4b and an intersection point D6bx of the outer circumference data D6b in the intersecting portions of the two curves. At this time, elementary data d7 of the satin stitch data D7b are created at a right angle with respect to the inner circumference data D4b and the outer circumference data D6b from numerous internal data d1 composing the contour data D1b.

(b) As shown in FIG. 15(*b*), a phantom line joining those intersection points D4bx and D6bx is set as a boundary 43 between the two-curve portions of the satin stitch data D7b.

(c) The seam direction of the two-curve portions of the satin stitch data D7b are set, as shown in FIG. 15(*c*), such that it takes a right angle with respect to the contour data D1a, as described above, at portions apart from the boundary 43 but is gradually changed the more into parallel with the boundary 43 as it comes the closer to the boundary 43.

Thanks to this setting the seam direction, the intersecting portion of the two curves of the applique patch 17 can be satin-stitched continuously without any seam spacing so that the appearance can be improved.

Figure 17:
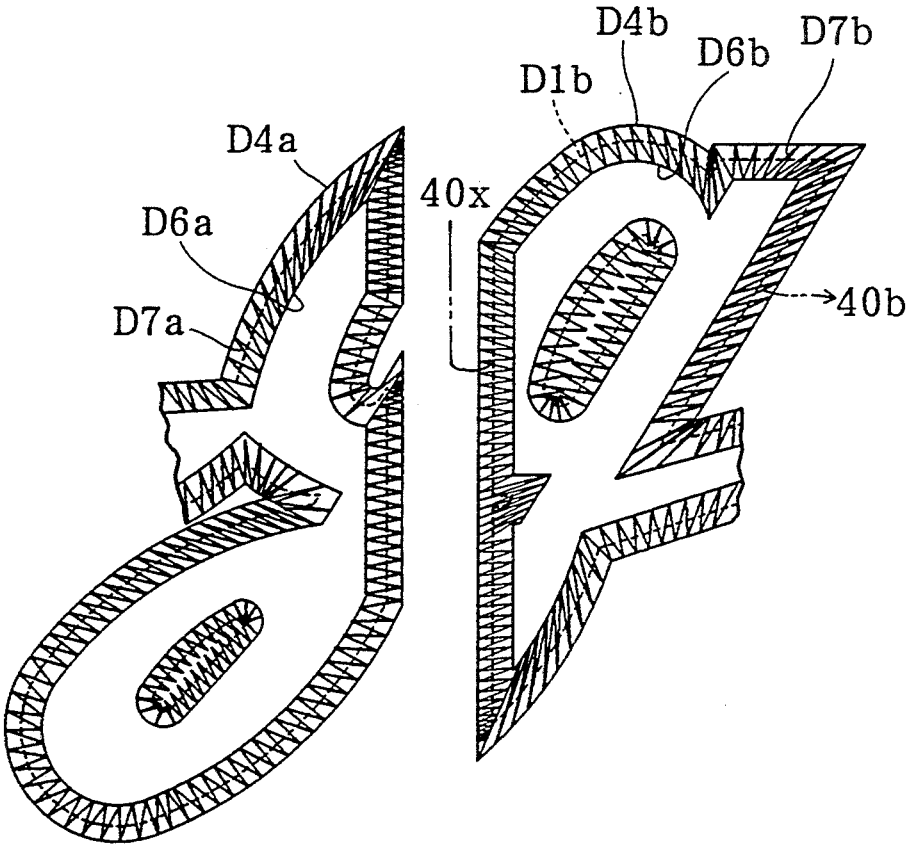
FIG. 17 is an enlarged view showing a portion of the satin stitch data created.

As shown in FIG. 17, moreover, the control unit 1 creates thread interchanging data (not shown) for interchanging the thread for a satin stitch 40*x* for stitching the overlap edge 19 of the upper applique patch 17 and the thread of a satin stitch 40*b* for stitching the remainder of the same applique patch 17. The individual satin stitch data D7a and D7b (containing the thread interchanging data, as in the following) are recorded in the floppy disk FD2 by the floppy disk driver 6.

Here at the time of creating the satin stitch data D7b, data of a reverse stitched portion for the catch stitching are created at the ending portion, and the ending stitch data are created at the final stitch of the reverse stitched portion. The data of these reverse stitched portion and the ending stitch are made to correspond one to one to the actual reverse stitched portion and the ending stitch, as will be described in the following with reference to FIGS. 22 to 26 showing the actual reverse stitched portion and the ending stitch.

Figure 22:
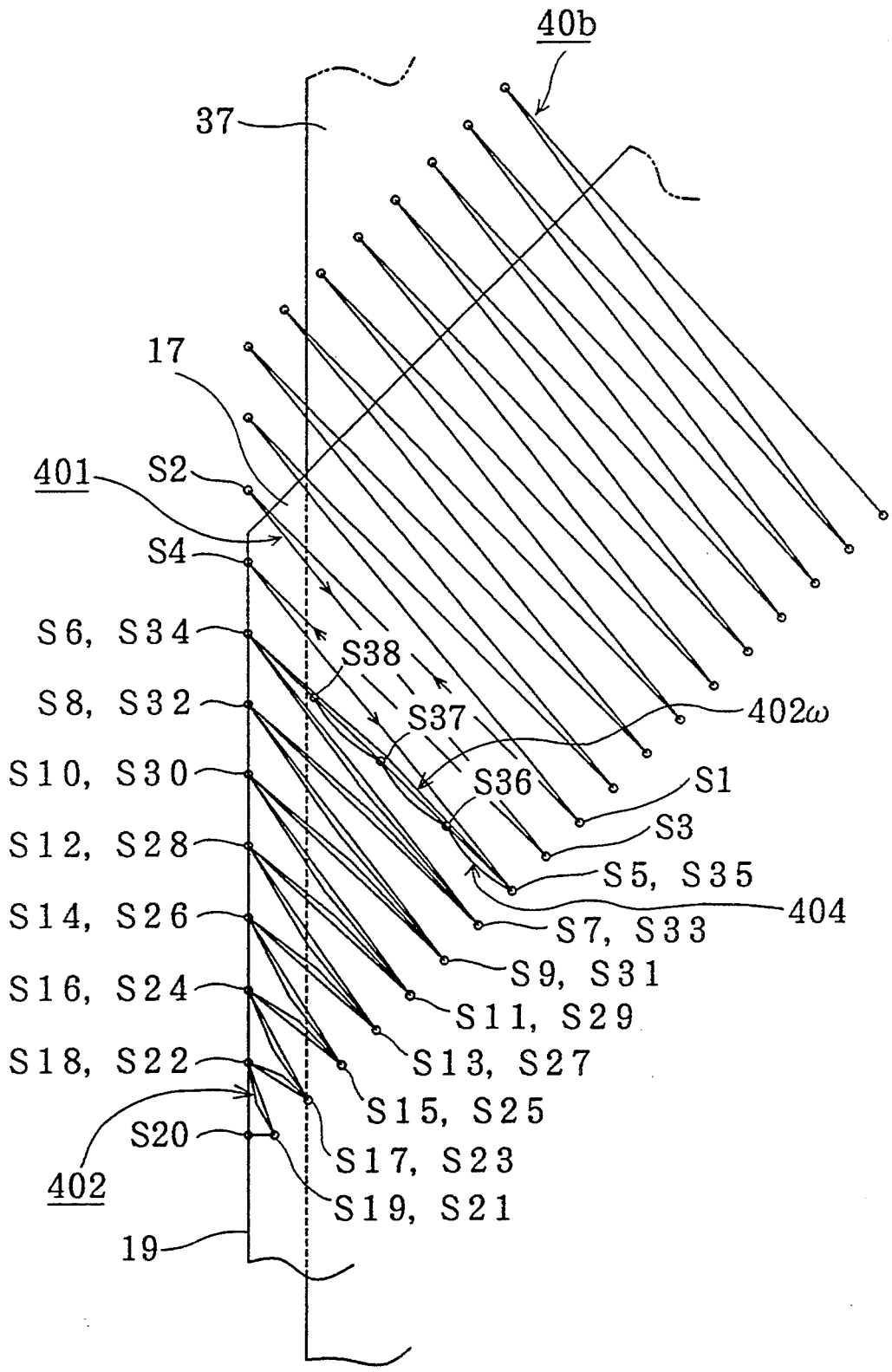
FIG. 22 is an enlarged front elevation showing a first mode of the portion, as indicated by arrows XXII--XXIV of FIG. 20.
Figure 23:
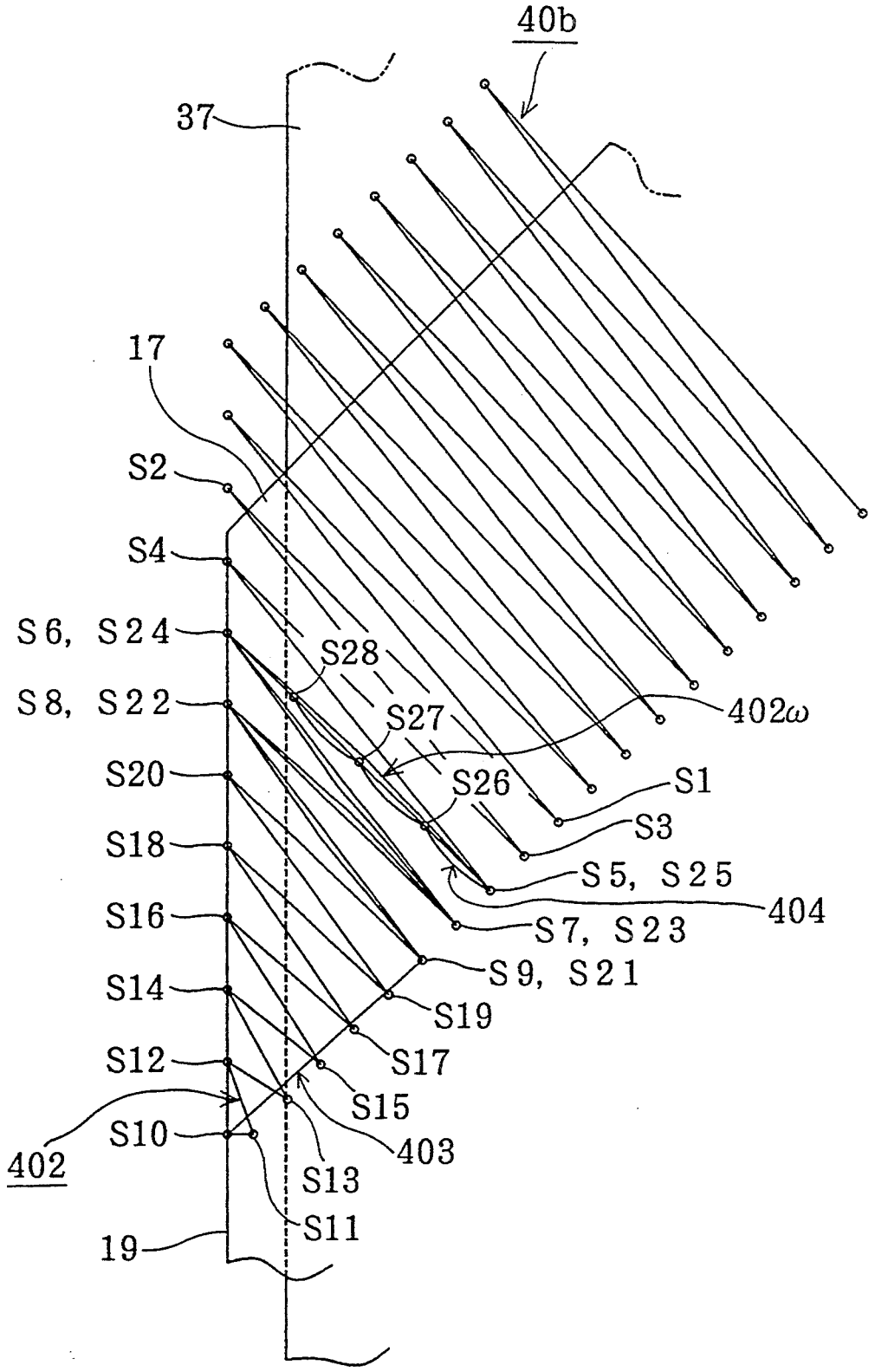
FIG. 23 is an enlarged front elevation showing a second mode of the portion, as indicated by arrows XXII-XXIV of FIG. 20.
Figure 24:
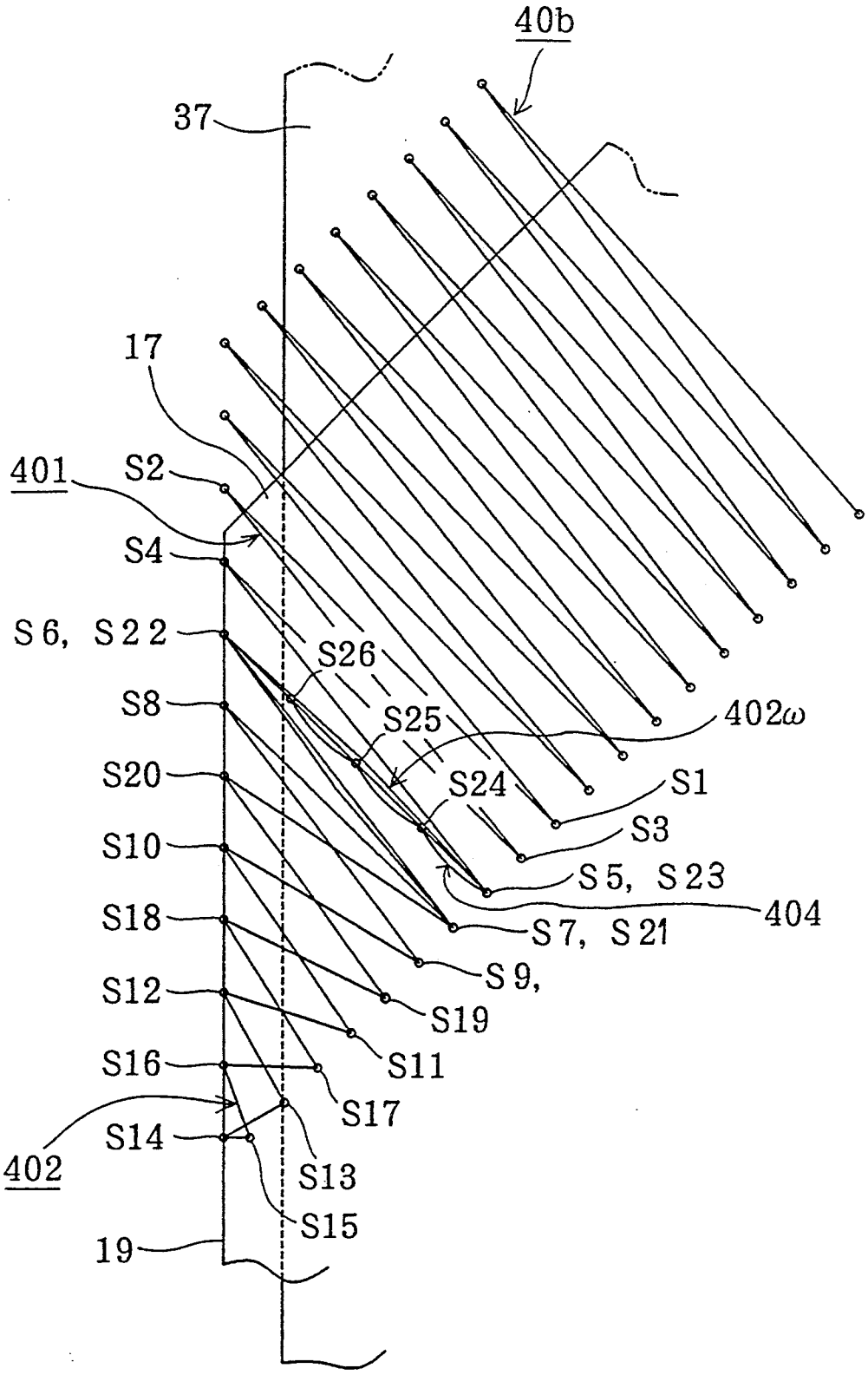
FIG. 24 is an enlarged front elevation showing a third mode of the portion, as indicated by arrows XXII--XXIV of FIG. 20.

FIGS. 22 to 24 are enlarged diagrams showing three kinds of modes in the portion, as indicated by arrows XXII–XXIV of FIG. 20. The red satin stitch 40*b* terminates in the vicinity of the edge portion of the upper front body 37. This satin stitch 40*b* is composed of: a forward stitch portion 401 formed from the non-edge portion to the edge portion of the upper front body 37; and a backward stitch portion 402 formed and terminated by nine to fifteen stitches such that they are reversed from the creation end of the forward stitch portion 401 to the non-edge portion of the upper front body 37. Individual data for forming those forward stitch portion 401 and backward stitch portion 402 are automatically created by the control unit 1 when the satin stitch data D7b are created, and their pitches naturally are correspondingly identical to those of the forward stitch portion 401 and the backward stitch portion 402 in the following individual modes.

More specifically, FIG. 22 shows a first mode, in which the forward stitch portion 401 is formed at a substantially constant pitch from the non-edge portion to the edge portion of the upper front body 37. If a point S1 in FIG. 22 is assumed to be a first stitch point, then the portion ranging sequentially in the order of numerals affixed to the letter S from the first stitch point S1 to a twentieth stitch point S20 forms a portion of the forward stitch portion 401 of a substantially constant pitch, and the portion ranging from the twentieth stitch point S20 to a thirty fifth stitch point S35 forms a portion of the backward stitch portion 402 (having fifteen stitches) of a substantially constant pitch.

FIG. 23 shows a second mode, in which the forward stitch portion 401 is formed at a substantially constant pitch in the non-edge portion of the upper front body 37 but by a jumping single stitch 403 from this side of the edge portion of the upper front body 37 to the edge portion. If the point S1 in FIG. 23 is assumed to be the first stitch point: the portion ranging sequentially in the order of numerals affixed to the letter S from the first stitch point S1 to a ninth stitch point S9 forms a portion of the forward stitch portion 401 of a substantially constant pitch; the portion from the ninth stitch point S9 to a tenth stitch point S10 forms the Jumping stitch 403 of the forward stitch portion 401; and the portion ranging from the tenth stitch point S10 to a twenty fifth stitch point S25 forms a portion of the backward stitch portion 402 (having fifteen stitches) of a substantially constant pitch.

FIG. 24 shows a third mode, in which the forward stitch portion 401 is formed at a substantially constant pitch in the non-edge portion of the upper front body 37 but at a coarser stitch from this side of the edge portion of the upper front body 37 to the edge portion and in which the backward stitch portion 402 is also formed at a coarse pitch. If the point S1 in FIG. 23 is assumed to be the first stitch point: the portion ranging sequentially in the order of numerals affixed to the letter S from the first stitch point S1 to a ninth stitch point S9 forms a portion of the forward stitch portion 401 of a substantially constant pitch; the portion from the ninth stitch point S9 to a fourteenth stitch point S14 forms the coarse stitch portion of the forward stitch portion 401; and the portion ranging from the fourteenth stitch point S14 to a twenty third stitch point S23 forms a coarse stitch portion of the backward stitch portion 402 (having nine stitches) of a substantially constant pitch.

It is ideal that the overlap edge 19 of the applique patch 17 be so arranged as to completely overlap the edge portion of the upper front body 37. As a matter of fact, however, due to the arrangement error, the overlap edge 19 may protrude by 1 to 2 mm (or as far as about 4 mm due to the error or extension of the applique patch) from the edge portion of the upper front body, or may extend far back by 1 to 2 mm from the edge portion of the upper front body 37. On the other hand, the position of establishing the satin stitch **40*b* refers not to the position of the upper front body 37 but to the position of the applique patch 17. That is, the backward stitch portion 402 is started not from the edge portion of the upper front body 37 but from the overlap edge 19 of the applique patch 17**.

Thus, let the case be considered, in which the overlap edge 19 of the applique patch 17 protrudes from the edge portion of the upper front body 37, as shown in FIGS. 22 to 24. If, in this case, the backward stitch portion 402 terminates at that protrusion of the applique patch 17, the thread end at the terminal point can catch the applique patch 17 but not the upper front body 37 so that it cannot hold the applique patch 17.

In the present embodiment, therefore, the backward stitch portion 402 is terminated not at the protrusion of the applique patch 17 but at the non-edge side of the extrusion by forming nine to fifteen stitches in the backward stitch portion 402, so that the thread end at the ending point may catch not only the applique patch 17 but also the upper front body 37, thereby to hold the applique patch 17. The stitch number of the backward stitch portion 402 is so dependent upon the pitch as may be the less for the coarser pitch.

In any of the aforementioned first to third modes, moreover, there is stitched over a final stitch 402ω of the backward stitch portion 402 such an ending stitch 404 having a small stitch length as is carried from the starting ends (i.e., thirty fifth stitch point S35 in the first mode, the twenty fifth stitch point S25 in the second mode and the twenty third stitch point S23 in the third mode) of the final stitch 420ω to the three quarters (i.e., S36 to S38 in the first mode, S26 to S28 in the second mode and S24 to S26 in the third mode) of the final stitch 402ω. The ending stitch 404 is ended at the final stitch point (i.e., S38 in the first mode, S28 in the second mode and S26 in the third mode), midway of the final stitch 402ω. The data of this ending stitch 404 are automatically created by the control unit 1 at the time of creating the satin stitch data D7b so that the ending stitch 404 is formed on the basis of the data.

Figure 25:
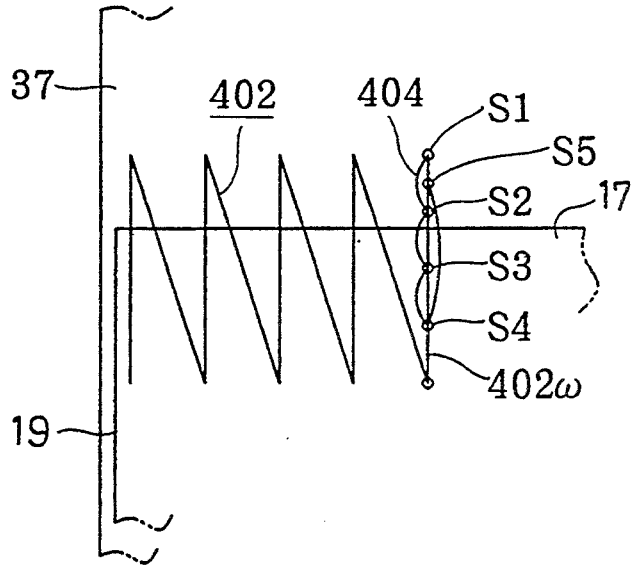
FIG. 25 is an enlarged front elevation showing a modification of an ending stitch which is shown in FIGS. 22 to 24.
Figure 26:
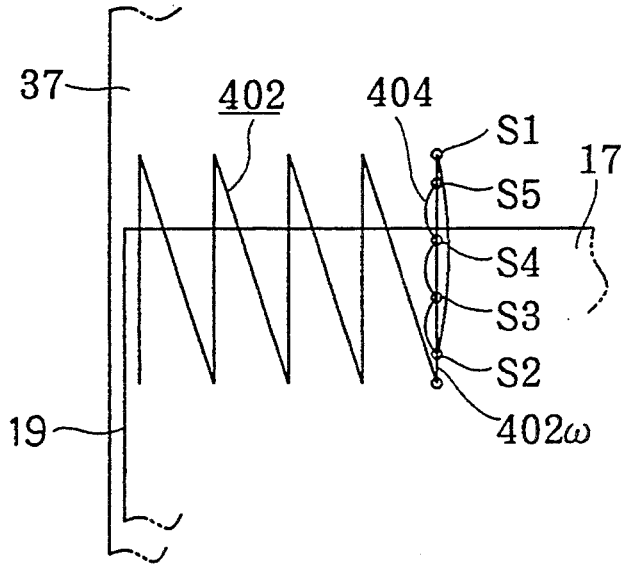
FIG. 26 is an enlarged front elevation showing another modification of the ending stitch which is shown in FIGS. 22 to 24.
Figure 27:
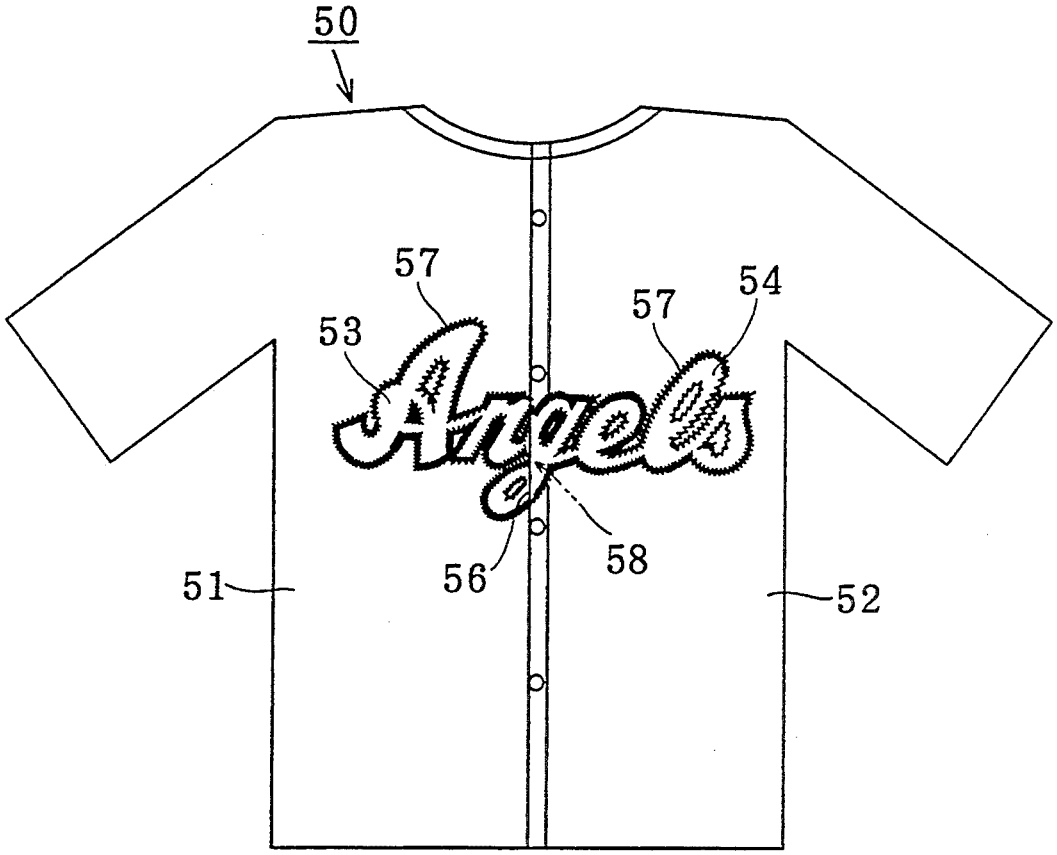
FIG. 27 (PRIOR ART)
FIG. 27 is a front elevation showing a uniform coat which has applique patches of the conventional art construction stitched thereto.
Figure 28:
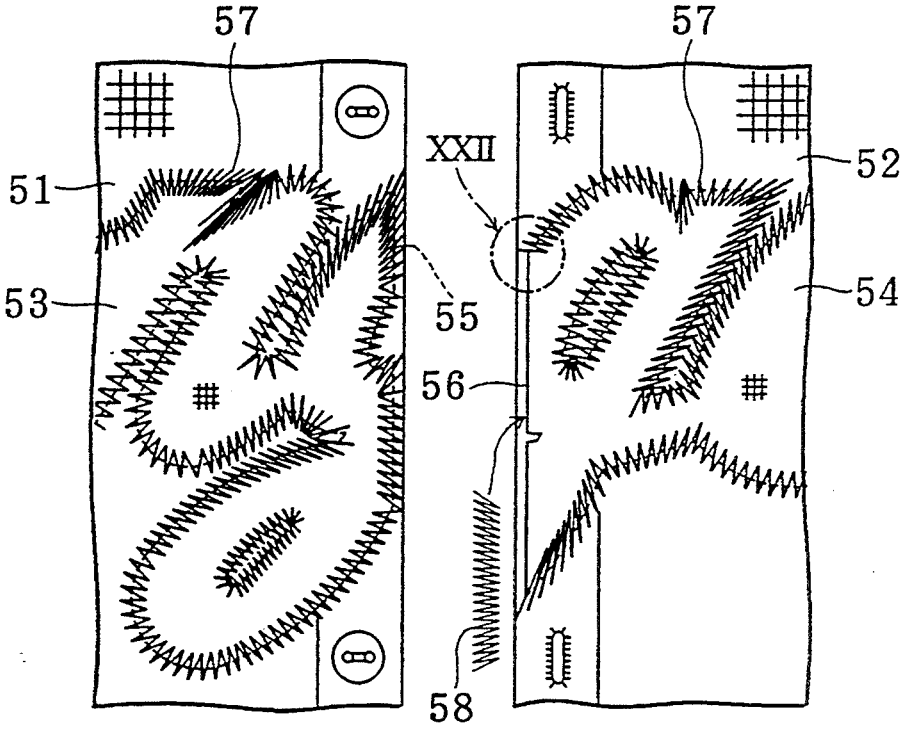
FIG. 28 (PRIOR ART)
FIG. 28 is a front elevation showing portions of the applique patches shown in FIG. 27.

FIGS. 25 and 26 show other modes of the ending stitch 404. In these modes, the forward stitch portion (not shown) is formed at a right angle with respect to the edge portion of the upper front body 37, and the backward stitch portion 402 is also returned at a right angle. If the starting end of the final stitch 402ω of the backward stitch portion 402 falls at the first stitch point S1, the ending stitch 404 of FIG. 25 is doubled while being carried from the first stitch point S1 through the three quarters S2 to S4 of the final stitch 402ω and is returned and ended from the stitch point S4 to the intermediate stitch point S5 between the two stitch points S1 and S2. The ending stitch 404 of FIG. 26 is jumped, if the starting end of the final stitch 402ω also falls at the first stitch point S1, from this first stitch point S1 to the stitch point S2 below the stitch point S3 and is ended after it has been doubled while being carried through the three stitch points S3 to S5. These data for the ending stitch 404 are also automatically created at the time of creating the satin stitch data D7b so that the ending stitch 404 is formed on the basis of the data.

Which of the modes of FIGS. 22 to 26 is to be adopted is individually determined by instructing the control unit 1 from the keyboard 3.

By the operations thus far described, there are created the floppy disk FD1 which is recorded with the cutting data D2a and D2b, and the floppy disk FD2 which is recorded with the three embroidering data, i.e., the positioning temporary stitch data D3a and D3b, the basting stitch data D5a and D5b and the satin stitch data D7a and D7b. The applique is formed in the following manner by using those floppy disks FD1 and FD2 and the aforementioned system.

(A) Cutting of Applique Patches

As shown in FIG. 1, the machine face 11 of the cutting machine 10 is set with the cloth 15 of the applique patches, and the floppy disk FD1 is inserted into the floppy disk driver 14 to run the cutting machine 10. On the basis of the cutting data D2a and D2b, the heat cutter 12 is brought into contact with the cloth 15 and is driven in the X-Y directions so that the applique patches 16 and 17 are thermally cut on the basis of the cutting data D2a and D2b. Only the lower applique patch 16 is shown in FIG. 1.

(B) Embroidering of Applique Patches

Figure 18:
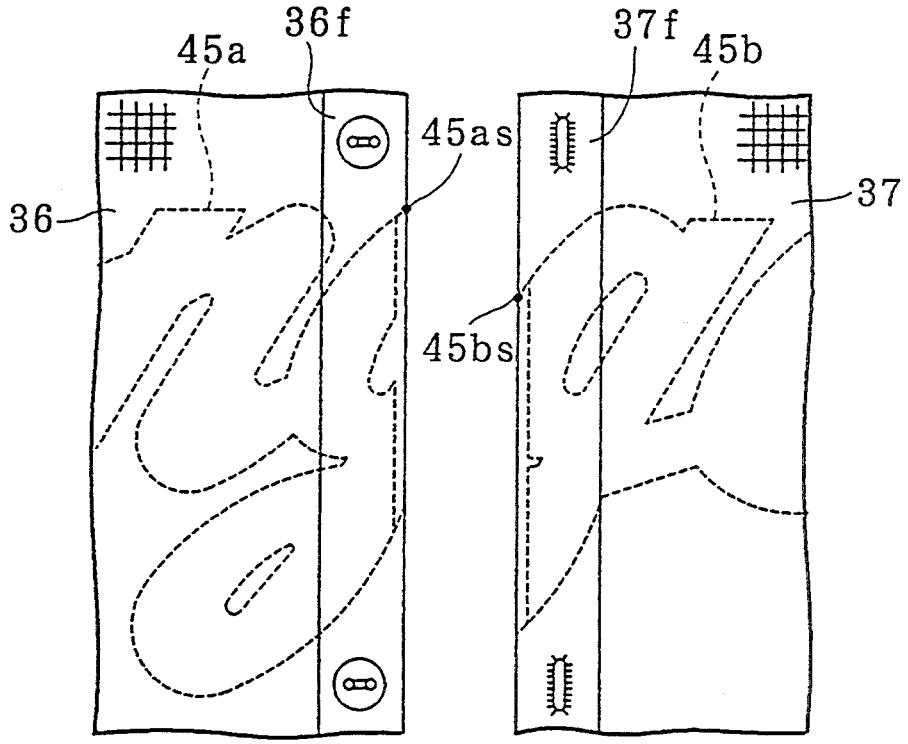
FIG. 18 is a front elevation showing portions of a lower front body and an upper front body of a coat which has been temporarily stitched for positioning.

<1> As shown in FIG. 1, the lower front body 36 (or the upper front body 37) is extended over the embroidery frame 24 of the embroidering machine 20, and the floppy disk FD2 is inserted into the floppy disk driver 34 to run the embroidering machine 20. Then, the needles of the embroidering heads 21 and the shuttle race, the embroidery frame 24 and so on of the bed 22 are driven at first on the basis of the positioning temporary stitch data D3a and D3b. As a result, positioning temporary stitches 45*a* are formed in the lower front body 36 by running stitches whereas positioning temporary stitches 45*b* are formed in the upper front body 37 by the same stitches, as shown in FIG. 18.

At this time, according to the data of the starting points Sa and Sb contained in the individual positioning temporary stitch data D3a and D3b, starting points 45*as* and 45*bs* of the individual positioning temporary stitches 45*a* and 45*b* are brought to the overlap edges (i.e., at the buttoned edges in case of the uniform coat 35) of the individual front bodies 36 and 37, so that they can be easily positioned for the needles of the embroidering machine 20. These positionings become difficult if the starting points go far from the overlap edges.

<2> Along the individual positioning temporary stitches 45*a* and 45*b*, the applique patches 16 and 17 are arranged on and adhered to the front bodies 36 and 37, respectively, by an adhesive or the like.

Figure 19:
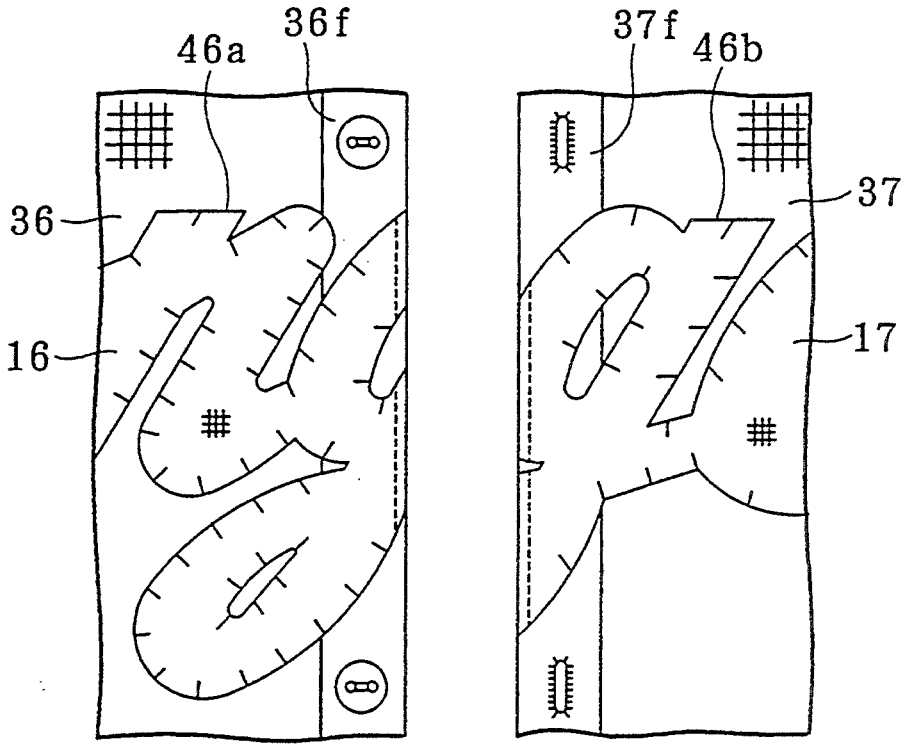
FIG. 19 is a front elevation showing portions of the lower front body and the upper front body of the coat, to which is basted applique patches.

<3> When the embroidering machine 20 is run again, the needles of the embroidering heads 21 and the shuttle race, the embroidery frame 24 and so on of the bed 22 are driven on the basis of the basting stitch data D5a and D5b so that basting stitches 46*a* and 46*b* are formed, as shown in FIG. 19. As a result, the applique patches 16 and 17 are coarsely basted to the lower and upper front bodies 36 and 37, respectively.

<4> When the embroidering machine 20 is then run, the needles of the embroidering heads 21 and the shuttle race, the embroidery frame 24 and so on of the bed 22 are driven on the basis of the satin stitch data D7a and D7b so that satin stitches 40*a* and 40*b* are formed, as shown in FIGS. 20 and 21. As a result, the applique patch 16 is embroidered to the lower front body 36. On the other hand, the upper applique patch 17 is formed at first with the satin stitches 40*x* at the overlap edge 19, and then with the satin stitches 40*b* in the portion other than the overlap edge 19 so that the applique patch 17 is embroidered to the upper front body 37.

Here, the threads of the satin stitches 40*a* and 40*b* are so selected that their colors may be different from those of the applique patches 16 and 17. In case these applique patches 16 and 17 are blue, for example, read threads are used for the satin stitches 40*a* and 40*b*. However, the satin stitch 40*x* of the overlap edge 19 of the upper applique patch 17, which will cross the letter "g" when it overlaps, has its thread color switched to substantially the same blue as that of the applique patches 16 and 17 by the thread interchanging data contained in the satin stitch data D7a and D7b. As a result, that satin stitch 40*x* will not deteriorate the appearance of the applique. Thus, in the present embodiment, the overlap edge 19 and the remaining portion (i.e., the non-edge portion) can be consecutively stitched by changing the threads according to the thread interchanging data so that the working efficiency can be enhanced.

Moreover, the red satin switch 40*b* is formed in the first to third modes shown in FIGS. 22 to 24, as described above. In any mode, the satin stitch 40*b* is terminated not at the edge portion of the upper front body 37, i.e., at the starting end of the forward stitch portion 401, but at the backward stitch portion 402 which is formed by returning it from the starting end of the forward stitch portion 401 to the non-edge portion of the upper front body 37, so that its ending point becomes reluctant to have its thread end frayed. Even if, moreover, the overlap edge 19 of the applique patch 17 protrudes from the edge portion of the upper front body 37 due to the arrangement error, the thread end of the ending point of the backward stitch portion 402 is caught not only by the applique patch 17 but also by the upper front body 37 by forming the backward stitch portion 402 of the nine to fifteen stitches, so that the applique patch 17 can be held.

According to the first mode of FIG. 22, moreover, the backward stitch portion 402 overlaps the forward stitch portion 401 of the substantially constant pitch so that it rises with an increased total stitch number. However, this increase in the total stitch number produces a stronger stitching force.

According to the second mode of FIG. 23, the backward stitch portion 402 overlaps the jumping stitch 430 of the forward stitch portion 401 so that it little rises to improve the appearance with a reduced total stitch number.

According to the third mode of FIG. 24, the backward stitch portion 402 overlaps the coarse pitch portion of the forward stitch portion 401 so that it little rises to improve the appearance with a reduced total stitch number.

In any of the first to third modes, moreover, the ending stitch 404 having a small stitch length is doubled at the final stitch 402$\omega$ and is terminated midway of the final stitch 402$\omega$, i.e., the final stitch point. As a result, the final stitch 402$\omega$ is firmly held on the upper front body 37 by the ending stitch 404, so that the thread end is made more reluctant to be frayed and the needle location is hidden to become inconspicuous.

In the modification of the ending stitch 404 shown in FIGS. 25 and 26, moreover, the final stitch 402$\omega$ is reciprocally doubled to enhance the fray preventing effect. Especially in the modification of FIG. 26, a portion of the ending stitch 404 holds the remaining portion to prevent it from floating.

The present invention can be embodied not only in the applique of the uniform coat but also in a variety of appliques which have their patches arranged to have their edge portions substantially registered with the edge portion of the cloth. Moreover, the present invention should not be limited to the construction of the foregoing embodiment but can be suitably modified in various manners without departing from the gist thereof.

What is claimed is:

1. A method of creating data for an applique which has its lower and upper applique patches embroidered to lower and upper cloths, respectively, such that the lower cloth and applique patch and the upper cloth and applique patch can overlap and separate each other with a predetermined overlap margin, comprising the steps of:

inputting synthetic contour data of the two applique patches when the lower and upper applique patches overlap each other with the predetermined overlap margin;

inputting individual overlap edge data of said lower and upper applique patches;

creating individual contour data of said lower and upper applique patches from said synthetic contour data and said individual overlap edge data;

creating the individual embroidering data of said lower and upper applique patches on the basis of the individual contour data of said lower and upper applique patches; and embroidering the lower and upper applique patches to the lower and upper cloths based on said individual embroidering data.

2. An applique data creating method according to claim 1, further comprising a step of creating individual cutting data of said lower and upper applique patches on the basis of the individual contour data of said lower and upper applique patches, which are created at said contour data creating step.

3. An applique data creating method according to claim 1, wherein the individual embroidering data of said lower and upper applique patches, which are created at said embroidering data creating step, include:

temporary stitch data for positioning said lower and upper applique patches individually for forming the positioning temporary stitches of said lower and upper applique patches, respectively, in said lower and upper cloths;

basting stitch data for temporarily stitching said lower and upper applique patches coarsely to said lower and upper cloths, respectively; and satin stitch data for satin-stitching said lower and upper applique patches, respectively, to said lower and upper cloths.

4. An applique data creating method according to claim 3, wherein said embroidering data creating step includes the sub-steps of:

creating the temporary stitch data for positioning said lower and upper applique patches, respectively, from the individual contour data of said lower and upper applique patches, which are created at said contour data creating step; and setting the starting point of said positioning temporary stitch data to the intersection points between said positioning temporary stitch data and the overlap edge data of the lower and upper applique patches, which are inputted at said overlap edge data inputting step.

5. An applique data creating method according to claim 3, wherein said embroidering data creating step includes the sub-steps of:

creating inner circumference data along the inner circumference of the individual contour data of said lower and upper applique patches, which are created at said contour data creating step; and creating the individual basting stitch data of said lower and upper applique patches from said individual contour data and said individual inner circumference data.

6. An applique data creating method according to claim 3, wherein said embroidering data creating step includes the sub-steps of:

creating inner circumference data and outer circumference data respectively along the inner and outer circumferences of the individual contour data of said lower and upper applique patches, which are created at said contour data creating step; and creating the individual satin stitch data of said lower and upper applique patches from said inner circumference data and said outer circumference data.

7. An applique data creating method according to claim 6, wherein said embroidering data creating step includes a sub-step of creating thread interchanging data in the satin stitch data of said upper applique patch, which are created in the same step, for interchanging the satin stitch thread for stitching the overlap edge of said upper applique patch and the satin stitch thread for stitching the remainder of said upper applique patch.

8. An applique data creating method according to claim 6, wherein said embroidering data creating step decides a creating side automatically and includes the sub-steps of:

extending search lines in one direction from arbitrary points of the individual contour data of said lower and upper applique patches, which are created at said contour data creating step, to the other portions of said contour data;

determining the number of intersection points between said search lines and other portions of said individual contour data; and creating said inner circumference data and said outer circumference data correctly at the inner circumference side and the outer circumference side with respect to said individual contour data on the basis of the extending direction of said search lines, the advancing direction of said individual contour data at said arbitrary points, and the number of said intersection points.

9. An applique data creating method according to claim 6, wherein in case the contour data of said lower and upper applique patches have two-curve intersecting portions, said embroidering data creating step includes the sub-steps of:

setting a phantom line Joining the intersection points of said inner circumference data and the intersection points of said outer circumference data in said two-curve intersecting portions as the boundary of the two-curve portions of the satin stitch data for satin-stitching said two curves; and changing the seam direction of the two-curve portions of said satin stitch data so gradually as to become the more parallel to said boundary as the closer to said boundary.

10. An applique data creating method according to claim 6, wherein in case the edge portion of said upper applique patch is arranged to be substantially registered with the edge portion of said upper cloth, said embroidering data creating step includes the sub-steps of creating the satin stitch data of said upper applique patch so that the satin stitch data of said upper applique patch and the data of a forward stitch portion formed from the non-edge portion to the edge portion of said upper cloth may contain the data of a backward stitch portion which is so terminated by at least four stitches as to be returned from the starting end of said forward stitch portion to the non-edge portion of said cloth.

11. An applique data creating method according to claim 10, wherein said embroidering step includes a sub-step of creating the data of said forward stitch portion at a substantially constant pitch from the non-edge portion to the edge portion of said upper cloth.

12. An applique data creating method according to claim 10, wherein said embroidering step includes a sub-step of creating the data of said forward stitch portion at a substantially constant pitch in the non-edge portion of said upper cloth and with Jumping stitch data from this side of the edge portion of said upper cloth and to the same edge portion.

13. An applique data creating method according to claim 10, wherein said embroidering step includes a sub-step of creating the data of said forward stitch portion at a substantially constant pitch in the non-edge portion of said upper cloth and at a coarser pitch from this side of the edge portion of said upper cloth to the same edge portion.

14. An applique data creating method according to claim 10, wherein said embroidering step includes a sub-step of creating basting stitch data having such a small stitch length as is doubled on the final stitch of said backward stitch portion from the starting end of said final stitch and is terminated midway of said final stitch.

* * * * *

UNITED STATES PATENT AND TRADEMARK OFFICE

CERTIFICATE OF CORRECTION

PATENT NO. : 5,438,520
DATED : August 1, 1995
INVENTOR(S) : Satoh, et al

It is certified that error appears in the above-indentified patent and that said Letters Patent is hereby corrected as shown below:

Column 16, line 45, claim 9, change "Joining" and insert --joining --.
Column 17, line 10, claim 12, change"Jumping" and insert --jumping --.

Signed and Sealed this

Nineteenth Day of December, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,438,520
DATED : August 1, 1995
INVENTOR(S) : Satoh, et al.

It is certified that error appears in the above-indentified patent and that said Letters Patent is hereby corrected as shown below:

On the title page, item [73], Assignees, line 1, change "Abushiki" and insert --Kabushiki--.

Signed and Sealed this

Twenty-sixth Day of March, 1996

*Attest:*

BRUCE LEHMAN

*Attesting Officer*

*Commissioner of Patents and Trademarks*